US008533932B2

(12) United States Patent
Hardouin-Finez

(10) Patent No.: US 8,533,932 B2
(45) Date of Patent: Sep. 17, 2013

(54) DEVICE AND PROCESS FOR ASSEMBLY OF PANELS USING RIVETING

(75) Inventor: Maxime Hardouin-Finez, Marly (FR)

(73) Assignee: Sonaca S.A., Gosselies (BE)

( * ) Notice: Subject to any disclaimer, the term of this patent is extended or adjusted under 35 U.S.C. 154(b) by 692 days.

(21) Appl. No.: 12/294,527

(22) PCT Filed: Mar. 26, 2007

(86) PCT No.: PCT/EP2007/052868
§ 371 (c)(1),
(2), (4) Date: Aug. 11, 2010

(87) PCT Pub. No.: WO2007/110406
PCT Pub. Date: Oct. 4, 2007

(65) Prior Publication Data

US 2011/0119897 A1 May 26, 2011

(30) Foreign Application Priority Data

Mar. 27, 2006 (BE) ..... 2006/0189

(51) Int. Cl.
*B21J 15/02* (2006.01)
*B21J 15/10* (2006.01)

(52) U.S. Cl.
USPC ..... 29/525.06; 29/34 B

(58) Field of Classification Search
USPC ..... 29/525.06, 34 B, 428, 432, 565, 29/566, 50, 52, 53, 54, 787, 795, 236, 243.53
See application file for complete search history.

(56) References Cited

U.S. PATENT DOCUMENTS

| | | | | |
|---|---|---|---|---|
| 2,216,403 | A | 10/1940 | Oeckl et al. | |
| 2,598,106 | A * | 5/1952 | Boyle | 408/61 |
| 2,978,791 | A | 4/1961 | Clar | |
| 3,946,470 | A | 3/1976 | Holland et al. | |
| 6,108,896 | A | 8/2000 | Gignac et al. | |
| 8,079,130 | B2 * | 12/2011 | Hardouin-Finez | 29/525.06 |
| 2005/0049126 | A1 | 3/2005 | Everson et al. | |

FOREIGN PATENT DOCUMENTS

| | | |
|---|---|---|
| EP | 0 293 257 A2 | 11/1988 |
| EP | 1 329 270 A1 | 7/2003 |

OTHER PUBLICATIONS

International Search Report for PCT/EP2007/052868; Jul. 6, 2007.

* cited by examiner

*Primary Examiner* — John C Hong
(74) *Attorney, Agent, or Firm* — Pearne & Gordon LLP

(57) ABSTRACT

A device (1) for assembling panels using riveting which includes a riveting system (6) together with a drilling system (4). According to the invention, the device includes components for setting the riveting head (38) in motion relative to a carriage (34) of the riveting system, where these components are designed to be capable of moving this riveting head (38) between an at-rest position in which the drilling head axis and the riveting head axis (16, 40) are distinct, and a working position in which the same axes (16, 40) coincide.

23 Claims, 19 Drawing Sheets

DEVICE AND PROCESS FOR ASSEMBLY OF PANELS USING RIVETING

TECHNICAL FIELD

The present invention relates in a general manner to the field of assembly of panels or thin metallic structures using riveting, with this technique being widespread in aeronautical construction activities.

The invention in effect finds a preferential application in but is not restricted to the field of robotic assembly using riveting of aircraft panels which exhibit highly curved drilling/riveting surfaces such as, for example, the leading edge of wings, or of those with lesser curvature, such as aircraft fuselage panels.

PRIOR ART

The devices used to assemble panels using riveting have already been widely developed in existing activities.

In the aeronautical industry these devices usually incorporate a chassis which, holds a drilling system, a riveting system, as well as a hold-down system. The hold-down system is usually operated first so as to establish contact with the panels to be assembled, then the drilling system in its turn drills the panels to produce a hole into which a rivet is then inserted, delivered by the riveting system. For indication purposes it should be noted that the hold-down system may be duplicated by a second hold-down system in order to apply pressure on both sides of the panel assembly. Moreover, depending on the options for access to this structure, the rivets are put in place from one side of the panels to be assembled, or from both sides of the latter.

The assembly formed by the chassis holding the various systems mentioned above is usually placed at the end of a robotic arm of the device, thus allowing this assembly to be brought to the desired location in relation to the panels to be assembled.

The drilling and riveting systems on existing devices, as described in document EP 1 329 270, are in general operated so that the riveting head and drilling head are alternately brought into the working axis of the device, in order to carry out one or more of the operations which are specific to them and involving the initiation of other movements.

This method of operation, which therefore requires that drilling and riveting systems are set in motion sequentially, requires that a relatively complex kinematic drive chain be present which combines many devices for carrying out rotation and translation movements and which results not only in an increased mass and greater overall volume, but above all in a loss of drilling precision.

In effect, an obvious loss of rigidity of the drilling head is observed which results not only from, the significant number of movement devices with which it is associated, but also due in particular to the fact that this multiplicity of movement devices encourages internal kinematic variations associated with the tooling to develop over time, which favours the development of play. These variations, combined with the flexibility of the robot arm carrying systems, naturally means that the drilling system does not exhibit sufficient rigidity in the drilling axis to be able to guarantee the formation of completely circular holes and/or regular countersinking.

OBJECT OF THE INVENTION

The purpose of the invention is therefore to propose a device and process for the assembly of panels using riveting which remedies, at least in part, the above mentioned problems associated with manufacturing using existing practices.

To this end the subject of the invention is a device for the assembly of panels using riveting, where the device includes a riveting system together with a drilling system, where the drilling system includes a first carriage, as well as a drilling head mounted on the first carriage, and defines an axis of the drilling head, and the riveting system which includes a second carriage as well as a riveting system head mounted on the second carriage and which defines an axis of the riveting head. According to the invention, the device additionally includes means for setting the riveting head in motion relative to the second carriage, designed to be capable of moving this same riveting head between an at-rest position where the drilling head axis is distinct from that of the riveting head, and a working position in which the drilling head axis and the riveting head axis coincide.

Advantageously, the device according to the invention provides improved precision of drilling, given that the kinematic drive mechanism associated with the drilling system may be simplified relative to those encountered in existing practice. In effect it is no longer necessary to set the drilling system in motion in order to ensure that the drilling and riveting systems are alternately put in position in the working axis.

This is explained by the fact that the solution that is proposed involves the drilling head remaining permanently in the device's drilling axis, whether during the drilling operation or during the riveting operation, since it is the riveting system itself which is designed so that its riveting head is alternately released from the working axis, and aligned along it by moving to a forward location in relation to the drilling head with which this riveting head is then also aligned.

Consequently the arrangement that is proposed provides a high degree of rigidity in the drilling axis, capable of ensuring that perfectly circular holes and regular countersinking are farmed.

Furthermore, it should be noted that the simplification of the kinematic drive chain associated with the drilling system is aimed not only at reducing the risk of internal kinematic variation associated with the tooling and which promotes the appearance of play, appearing over time, but also advantageously leads to a reduction in the mass of the device, as well as of its overall volume.

According to one preferred option for construction, the means for setting the riveting head in motion relative to the second carriage are means for initiating rotation, where the rotation movement sought is then produced along a second axis parallel to the drilling axis, and which is distinct from the drilling head axis.

In such a configuration which is not, it should be emphasised, intended to be restrictive in any way, the aforementioned axis of rotation, the drilling head axis and the riveting head axis are therefore permanently parallel to each other, and sometimes even coincide as far as the drilling head and riveting head are concerned.

The device may also include a chassis on which are mounted both the riveting system and the drilling system, with the first and second carriages each being arranged so as to be capable of sliding in a rectilinear manner relative to the chassis, along the same slide direction. With this arrangement it is preferable if the device is designed to include in addition some means of coupling which, when they are in an activated state, allow the first and second carriage to be coupled to each other in translation along the slide direction, and when they are in a deactivated state, allow these first and second carriages to slide relative to one another along this same slide direction.

This specific feature advantageously allows the same drive means to be used to produce movement in the slide direction of both the drilling system carriage, and also of the riveting system carriage at the same time. This naturally leads to a simplified design as well as to a reduction in mass and volume.

To do this the means of coupling include, for example, a guide rail which is arranged along the slide direction and which is firmly fixed to the first carriage, and at least one pad in the form of a brake calliper which can be actuated, fixed firmly to the second carriage, where the brake calliper which can be actuated fits against the guide rail.

It would be possible, however, to envisage movement of each of the first and second carriages being initiated by means for initiation of movement which are not common, but distinct, without going beyond the scope of the invention.

According to another mode of construction of the present invention which is even more preferable, the means for setting the riveting head in motion relative to the second carriage include a parallelogram whose shape can change, which in general allows the design of the device to be simplified even further and which therefore no longer requires the aforementioned means for initiating rotation to be present. The use of a parallelogram whose shape can change, similar to pantograph, in general terms ensures simplified sequencing of the riveting operation which follows the drilling operation, and therefore provides improved efficiency of the device. In effect, as will be described in more detail below, it should be noted that the parallelogram is designed to change shape so that brings the riveting head into its working position in which the drilling head axis and the riveting head axis coincide, where this change in shape may advantageously be effected automatically during a single movement of the second carriage, preferably in parallel with the drilling head axis.

More specifically, the means for setting the riveting head in motion relative to the second carriage include:

- two parallel arms which form the parallelogram which can change shape, each articulated at one of its two ends with the second carriage and articulated at the other of its ends with the riveting head;
- a mechanical system for changing the shape of the parallelogram designed so as to produce, when the second carriage is sat in motion along a slide direction, a change in shape of the parallelogram from a first configuration which places the riveting head in its at rest position, to a second configuration which places the riveting head in its working position, and vice versa.

Consequently it should be understood that the second carriage and the riveting head respectively form two parallel sides of the parallelogram whose shape can be changed, with the other two parallel sides being formed, of course, by the aforementioned arms.

Furthermore, as stated previously, it is preferably envisaged that the parallelogram changes shape in a predetermined manner during a single initiation of movement of the second carriage along a slide direction which is preferably the same as the direction of movement of the riveting head at the end of the riveting operation, that is, along the direction of the working axis of the device, itself parallel to the direction of the drilling head axis. Consequently this preferred mode of construction is noteworthy in that the sequencing of the riveting operation is simplified in the extreme, given that it only involves setting the second carriage in motion along the slide direction.

The mechanical system for changing shape is preferably a guide system which includes a pin which is firmly attached to one of the parallel arms, with the pin sliding in a guide slot when the second carriage is set in motion along the slide direction. The slot, similar to a switching track or rail, has a shape which is suitable for ensuring that the desired change of shape of the parallelogram is achieved.

It should therefore be noted that the guide slot preferably successively exhibits a first portion which allows the parallelogram to be maintained in its initial configuration placing the riveting head in its at rest position, a second portion which gradually allows the parallelogram shape to change until it takes up its second configuration, placing the riveting head in its working position, and a third portion which allows the parallelogram to be maintained in its second configuration in order to allow riveting operations to take place. Each of the three contiguous portions is preferably rectilinear, respectively aligned in three distinct directions. In this respect it is preferably envisaged that the first and third parts are parallel to one another and parallel to the working axis, whereas the second part is inclined relative to these in order to ensure that the riveting head is gradually brought towards the working axis. Finally, it is indicated that the guide slot, which is preferably located in one plane, may not include the first aforementioned portion, but the other two portions only which respectively ensure firstly a change in shape of the parallelogram in order to bring the riveting head into its working position, then maintains the parallelogram in this modified shape in order to set this head in translation motion to carry out the riveting operation along the working axis.

The device preferably includes a chassis carrying the guide slot and on which are mounted both the riveting system and the drilling system, with the first and second carriages each being arranged so as to be capable of sliding in a rectilinear manner relative to the chassis, along the same slide direction, with the drilling system including means for setting the first carriage in motion in the slide direction, and the riveting system also including means for setting the second carriage in motion in the slide direction.

Alternatively, it could be envisaged that the first and second carriages respectively slide in two different directions, that is, not parallel to each other. Furthermore, another possibility would be to use same means for setting the first and second carriages in motion in a manner which is the same as or similar to that described above which includes means of coupling.

In order to restrict the overall volume of the device as much as possible, the means for setting the second carriage in motion in the slide direction include a rodless cylinder of conventional design and familiar to those working in the field. An alternative solution would, for example, involve the use of a linear motor, as is preferably used to construct the means for setting the first carriage in motion. In such a case, the linear motor employed is of the type widely available on the market.

Preferably again, irrespective of the preferred mode of construction involved, the first carriage is also preferably mounted on two guide rails firmly attached to the chassis, using multiple pads in the form of callipers which fit against the two guide rails and which are firmly fixed to the first carriage. It may then be envisaged that each of these guide rails for the first carriage are fitted with a core, arranged respectively in two inclined planes which together form a V in a section taken orthogonally the drilling head axis.

Thus activation of the solenoid of a primary component of the linear motor creates electromagnetic forces which cause movement of the first carriage on the rails and also attraction of the carriage to a secondary component which usually takes the form of a track of permanent magnets. The effect of this attraction is to cause the first carriage to be pressed onto the guide rails which, because of their V arrangement assist greatly keeping the drilling head centred in the working axis. Effectively, in operation these support forces continually maintain the first carriage on the rails arranged as a V, thus preventing play occurring which generates vibration and which would be extremely prejudicial to drilling precision.

For indication purposes, each of the two guide rails of the first carriage preferably has an I-shaped transverse section.

Furthermore, it could be preferentially envisaged that the first carriage be equipped with a first reading head designed to fit against an optical rule placed on the chassis. This allows the first carriage to undergo controlled micrometric movements on the device chassis, and therefore allows the creation of holes/countersinking with very precise dimensions to be envisaged.

The second carriage of the riveting system is in turn preferably mounted on a guide rail firmly attached to the chassis, and also aligned in the slide direction using at least one pad in the form of a calliper which fits against the guide rail and which is firmly fixed to the second carriage. Preferentially it is envisaged that this rail be distinct from the two guide rails on which the first drilling system carriage is secured. As an indication, the said rail is used both for the case where the riveting head is fitted on the means for initiating rotation and for the case where it is carried by a parallelogram which can change shape.

The device also preferably includes a hold-down system arranged in such a way as to be capable of sliding in a rectilinear manner relative to the chassis, along the slide direction. The hold-down system preferably includes a third carriage mounted on the chassis, together with means for setting this third carriage in motion in the slide direction.

In this respect it is preferably envisaged that the means for setting the third carriage in motion take the form of a linear motor, which may be such that it has a fixed secondary element in common with the linear motor of the first carriage, namely a track of permanent magnets placed between the two guide rails of the first carriage. This specific feature also allows the number of kinematic linkage elements in the device to be reduced, the consequence of which is a further reduction in the mass and overall volume of the device.

It could therefore also be envisaged that the third carriage be mounted on the two guide rails which guide the first carriage, using multiple pads in the form of a calliper which fit against these two guide rails and which are firmly fixed to the third carriage.

Here again the third carriage is equipped with a second reader head designed to fit against an optical rule placed on the chassis, which is of course preferably identical to that which fits against the first reader head with which the drilling system carriage is equipped. As stated above, this advantageously allows micrometric movements of the third carriage on the chassis to be envisaged.

Furthermore, it is indicated that the hold-down system has a hold-down head fitted on the third carriage and which defines a hold-down head axis which coincides with the drilling head axis.

It is envisaged that the chassis be preferably mounted on a robot arm of the device, for example by means of a five-axis head.

In addition, the device also preferably includes a control system provided with means for delivering advance speed settings for a drilling tool for the device, along the drilling axis together with rotation speed settings for this tool, where these settings depend on information on the local stiffness of panels at a hole to be drilled in order to receive a rivet.

Thus by using information on the local stiffness of the panels to control the hole drilling operation, which in a conventional but non-restrictive manner involves the creation of this hole as well as, preferably, countersinking designed for the rivet head housing, it is advantageously possible to guarantee that a perfectly circular hole is formed without delamination when drilling composites, together with regular countersinking at the end of this hole.

Finally one objective of the invention is a process for assembly of panels using riveting carried out using a device such as that which has just been described.

Other advantages and characteristics of the invention will appear in the detailed non-restrictive description below.

BRIEF DESCRIPTION OF THE DRAWINGS

This description will be made in relation to the appended drawings, in which.

DETAILED DESCRIPTION OF PREFERRED EMBODIMENTS

Figure 1:
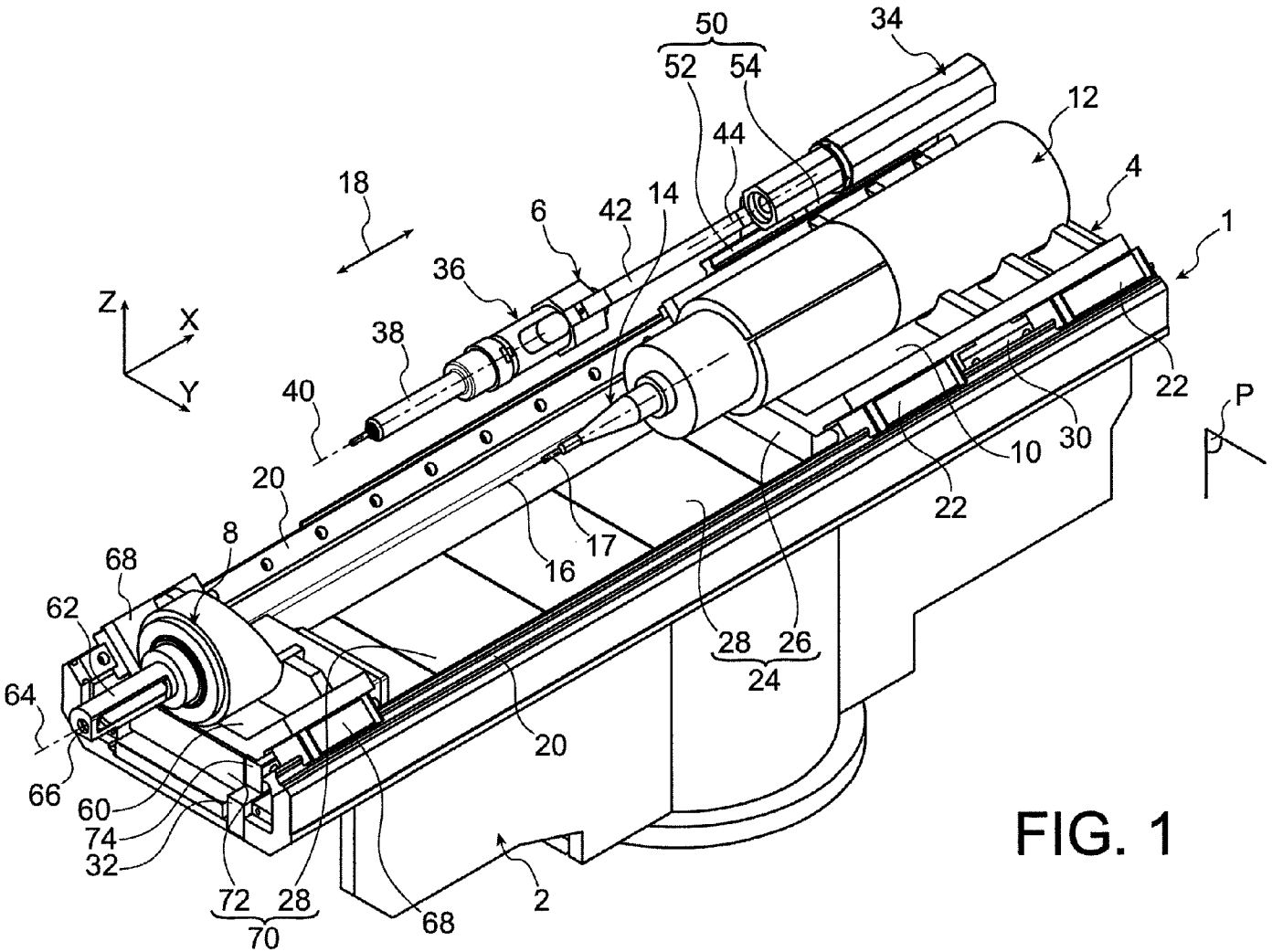
FIG. 1 represents a perspective view of a part of the device for assembling panels using riveting which is in accordance with one preferred mode of construction of the present invention.
Figure 2:
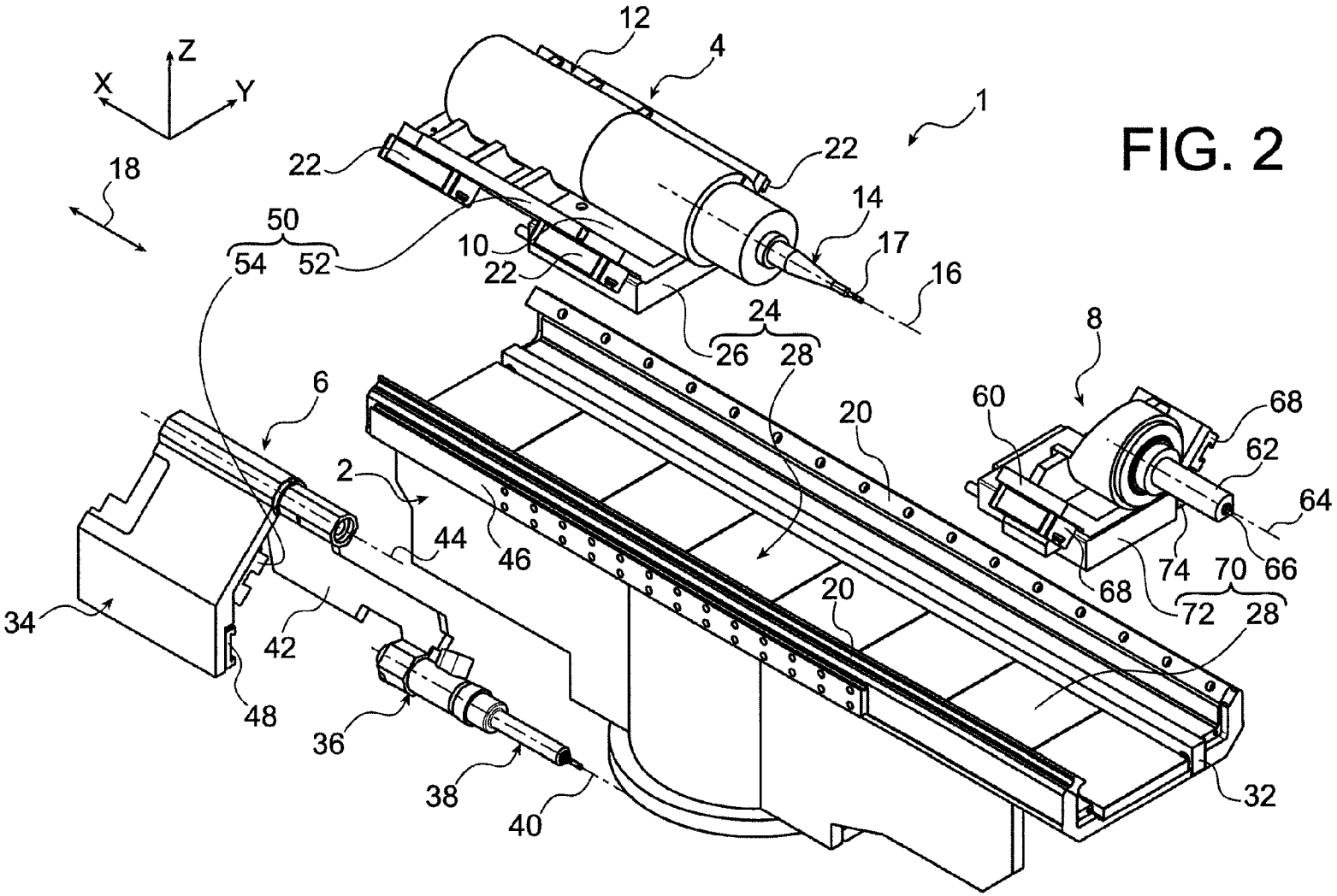
FIG. 2 shows an exploded perspective view of the device shown in FIG. 1.
Figure 3:
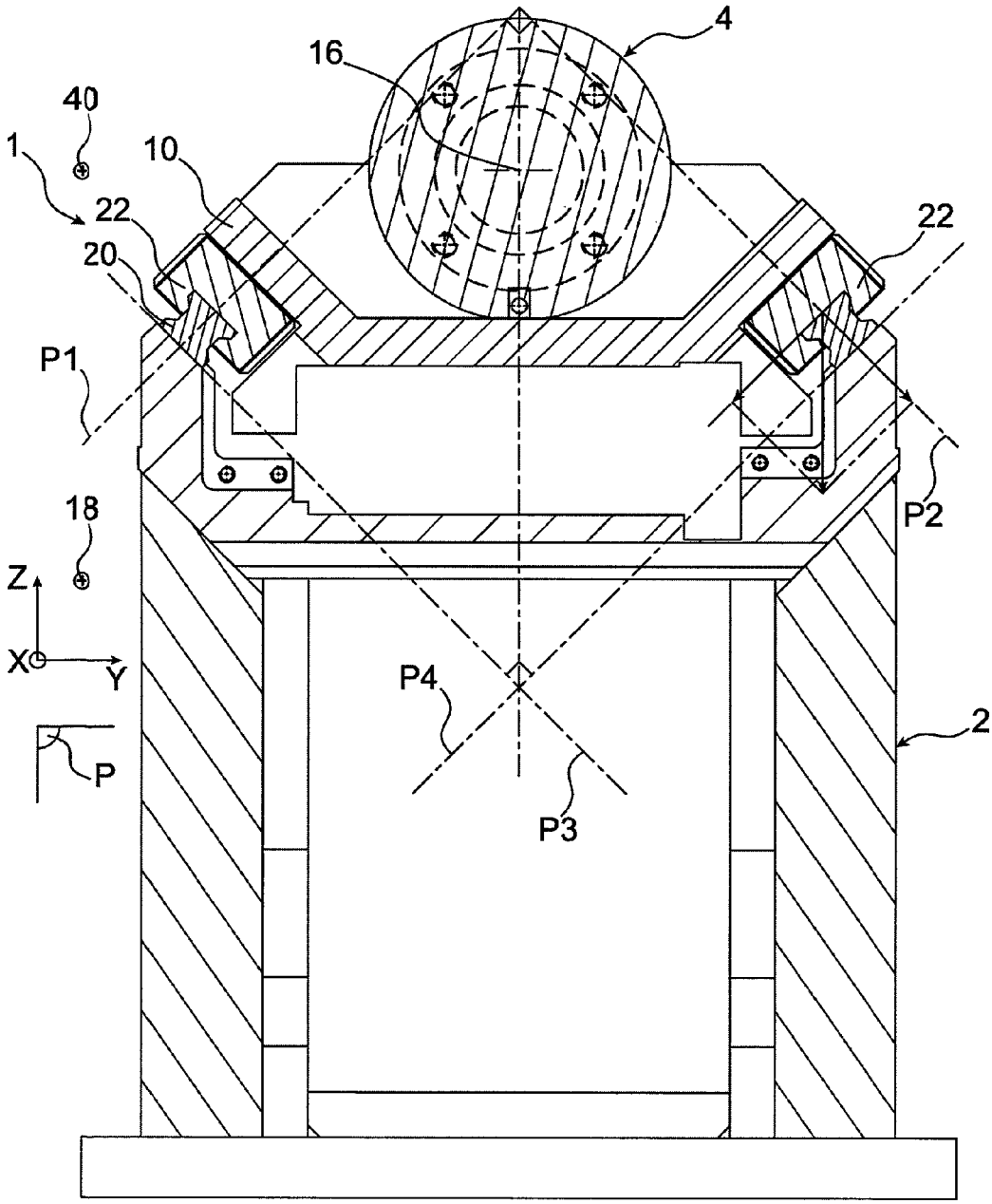
FIG. 3 shows a section view taken through plane P of FIG. 1.

With reference first of all to FIGS. 1 to 3 taken together, a part of the device 1 for assembling panels using riveting in accordance with a preferred mode of construction of the present invention can be seen, where the panels are of a metallic type or made from any other material such as from composite materials.

This device 1 according to the invention, which finds a particular application in the field of aeronautical construction, may be adapted to allow any type of rivet to be fitted automatically, such as pop rivets and/or staked rivets, and/or flattened rivets without exceeding the limits of the invention. It should nevertheless be noted that the device 1 is preferably designed for working blind using pop rivets.

The part of the device 1 represented in FIGS. 1 to 3 only relate to an end portion of this device, and is preferably made up of a tool which can be removed/fitted which is designed to be assembled to the end of a robotic arm (not shown) preferably forming en integral part of this device. As an indication, should be noted that the junction between the end of this robot arm and the tool part which will now be described may be made up of a five-axis head familiar to those working in the field and which allows this tool to be aligned very precisely in space.

For reasons of clarity, the description of the device 1 will be made with reference to a system of axes for this device, which is specifically attached to a chassis 2 of the latter, also known as the tool chassis. Thus the longitudinal direction of the device is called X; Y is the direction aligned transversely relative to this device, and Z is the vertical direction or height, where these three directions are orthogonal to each other. It is understood, naturally, that the aforementioned system of axes moves accordance with the same movement as that of chassis 2, operated by the robot arm.

The device 1 therefore includes overall, attached to the chassis 2, three systems designed to ensure different functions, namely a drilling system 4, a riveting system 6, together with a hold-down system 8. For information, it is indicated here that these systems are also known as actuators or effectors.

As far as the drilling system 4 is concerned, the latter has a first carriage 10 which holds the drilling spindle 12, which on its front part has a drilling head 14 equipped with a drilling tool 17 and which defines a drilling head axis 16, also known as the drilling tool axis, along which this tool is arranged. More specifically, the spindle 12 is fixed firmly to the carriage 10, so that the relative positions between the axis of the drilling head 16 aligned along direction X and this carriage 10 is designed to remain unchanged throughout an assembly cycle using riveting. As an indication, the drilling head 14 is conventionally made up of the drilling tool 27, together with the support for this tool, of a mandrel or similar type.

The first carriage 10 is fitted on the chassis 2 in such a way that it can slide in a rectilinear manner relative to the latter in a slide direction 18 parallel to direction X. To do this the carriage 10 is mounted so that it slides on two guide rails 20 aligned in direction X, and consequently also aligned in the slide direction 18, where these two rails are spaced apart from each other in direction Y.

More precisely with reference to FIG. 3 which shows a transverse section in a plane P aligned along directions Y and Z and which passes through the drilling system 4, it may be seen that the two rails 20 which have, for example, an I-shaped transverse section, are arranged so that the two cores of these I's are respectively located in two inclined planes P1, P2 which together form a V. In addition, the upper tracks of these two rails 20 are therefore also respectively located in two inclined planes P3, P4 which together form a V, with the point of this last V being aligned downward in the direction Z. It should be noted that these two Vs each have two symmetric branches between them relative to a vertical plane XZ passing through the axis 16, and which together form an angle of about 90°.

The V-shaped arrangement of the upper tracks of the rails 20 allow easy and Precise adjustment of the carriages arranged on these rails, and overall allows any unwanted movement of these carriages to be locked when they are in translation movement on the rails.

In order to allow it to be secured onto the rails 20, the carriage 10 is fitted with multiple bearing pads 22 in the form of a calliper, designed, for example, so that there are four in number, with two of these associated with one of the rails 20, and the remaining two associated with the other of these rails. Each of these pads 22 therefore grips the upper branch of the 'I' of one of the two rails 20, as can be seen more easily in FIG. 3.

In order to allow movement for the first carriage 10 in the slide direction 18 relative to the chassis 2, the drilling system 4 incorporates means for initiating movement 24, which preferably takes the form of a linear motor which includes a primary mobile element 26 on board the first carriage 10, together with a secondary fixed element 28 mounted on the chassis 2.

As can clearly be seen in the figures, chassis 2 has an overall U-shape in section along a plane YZ, at the two ends of which are fixed the two rails 20. Between the two arms of this U is a magnetic path made up of rare-earth permanent magnets, whose North and South polarities alternate along this path. This path, placed underneath the first carriage 10, therefore forms the secondary fixed component 28 of the linear motor 24.

Thus activation of the solenoid fitted to the primary mobile component 26 of the linear motor 24 creates electromagnetic forces which provide, on the one hand movement of the first carriage 10 on the rails 20 in direction X and on the other hand an attraction along direction Z between this carriage 10 towards the fixed secondary component 28.

In order to achieve micrometric precision in the movement of the carriage 10, it is envisaged that the latter be equipped with a reader head 30 which fits against an optic rule 32 placed on the chassis 2 along direction X. This rule is preferably made up of a glass bar which bears graduations of very high precision. Thus the reader head 30 converts markings on the rule 32, which are read as the carriage 10 passes them, into electronic signals, in order to give its exact position on the guide rails 20.

The description of the drilling system 4 which has just been given shows one of the specific features of the present invention, namely, that the axis of the drilling head 16 is designed to remain permanently in the working axis of the device, and is therefore not in any case intended to be given any movement relative to the chassis 2 during operation of the device.

Still with reference to FIGS. 1 to 3, for its part the riveting system 6 includes a second carriage 34 which supports the entire riveting tool 36 or riveter, the front part of which includes a riveting head 38, which in turn defines a riveting head axis 40 which is parallel to directions X and 18. More precisely, the riveting head 38, and more generally the riveting tool assembly 36, is mounted so that it is firmly fixed to the front of an offset arm 42 which overall extends in direction X, and whose rear part is mechanically connected to the carriage 34.

The aforementioned mechanical connection is constructed using means for initiation of movement (hidden in the figures) designed to cause the arm 42 and the head 38 which is firmly fixed to it to rotate in relation to the carriage 34 around an axis of rotation 44, with the aim of moving this same riveting head 38 between an at-rest position in which the drilling head axis 16 and the riveting head axis 40 are distinct and parallel as shown in FIGS. 1 and 3, and a working position in which these axes 16, 40 coincide, as will be explained later. The means for initiating movement therefore preferably take the form of a conventional rotary motor, whose axis of rotation 44 is preferably parallel to directions X and 18, and naturally distinct from the axes of the drilling head and of the riveting head 16, 40. This means that starting the rotary motor causes a movement of the head relative to the carriage 34, with this movement describing a trajectory which corresponds to a part of a circle located in a plane YZ.

The second carriage 34 is fitted to the chassis 2 so that it may slide in a rectilinear manner relative to it in the slide direction 18. To do this the second carriage 34 is mounted so that it slides on a guide rail 46, preferably distinct from the two guide rails 20 of the carriage 10, but also aligned along directions X and 18. As shown in FIG. 2, the rail 46 with a transverse section in the form of an H is firmly fixed to a lateral external surface of one of the arms of the U formed by the chassis 2.

In order for it to be secured on the rail 46, the carriage 34 is equipped with one or more bearing pads 48 in the form of a calliper, for example as a set of two, spaced out along direction X. Each of these pads 48 therefore presses against the free side arm of the N which is opposite the other side arm which is firmly fixed to the chassis 2.

The carriage 34 for the riveting system 6 preferably contains no means of its own for initiating translation movement, but is envisaged as being able to couple to the carriage of the drilling system 4, and may consequently be made to move along the direction 18 by the operation of the first linear motor 24 described above.

In effect means of coupling 50 are envisaged which, when they are in an activated state, allow the first and second carriage 10, 34 to be coupled in translation along direction 18, and when they are in the deactivated state, allow these same carriages to slide relative to one another.

To do this it is envisaged, for example, that these means 50 include a guide rail 52 firmly fixed to the first carriage and arranged along directions X and 18, as well as at least one pad 54 in the form of a brake calliper which may be actuated, firmly fixed to the second carriage 34, and more specifically with one upper inclined part of the latter which tends to move towards the spindle 12 in order to minimise the overall volume. Thus, depending on whether or not it is wished to couple these two carriages in translation along direction 18, the brake callipers 54 secured permanently to the free upper part of the rail 52 with a transverse I-shaped section are consequently actuated, for example electromagnetically. In this respect it should be noted that in the case envisaged where the riveting system 6 is equipped with its own means of initiating translation movement, the latter may then take any form familiar to those working in the field, such as, for example, by incorporating a hydraulic actuator.

The direct coupling above also allows, of course, micrometric precision to be achieved in movements of the carriage 34, thanks to the reading head 30 fitted to the carriage 10 and to the optical rule 32 placed on the chassis 2.

As far as the hold-down system 8 is concerned, the latter has a third carriage 60 which holds a hold-down head 62, also known as pressurisation gun, and which defines a hold-down head axis 64 aligned along directions X and 18. In a manner which is familiar to those working in the field, the head 62, designed to bring the panels to be assembled during drilling and riveting operations into contact with each other, is provided with a through hole 66 arranged along the hold-down head axis 64 and designed so that the drilling head 17 and the riveting head 38 alternately pass through it. More precisely this head 62 or gun is fitted firmly to the carriage 60, so that the relative position between the hold-down head axis aligned along direction X and this carriage 60 is designed to remain unchanged throughout a cycle in which assembly is carried out using riveting.

Furthermore, one of the specific features of this preferred mode of construction relies on the fact that the axes 64 and 16 permanently coincide during the cycle in which assembly is carried out using riveting.

The third carriage 60 is fitted on the chassis 2 in such a way that it can slide in a rectilinear manner relative to the latter along a slide direction 18. To do this the carriage 60 is mounted so that it slides on two guide rails 20 arranged in a V as described earlier, in a forwards direction relative to the first carriage 10 of the drilling system, it being understood, naturally, that forwards and backwards are here determined as a function of the orientation of the drilling tool used by the system 4.

In order to allow it to be secured onto the rails 20, the carriage 60 is fitted with multiple bearing pads 68 in the form of a calliper, envisaged, for example, as a set of 4 in number, with each of these associated with one of the two rails. Each of these pads 68 therefore grips the upper arm of the I of one of the two rails 20.

In order to allow the third carriage 60 to move in the slide direction 18 relative to the chassis 2, the hold-down system 8 incorporates means for initiating movement 70, which preferably take, the form of a linear motor which includes a primary mobile element 72 on board the third carriage 60, together with a secondary fixed element 28 mounted on the chassis 2, and which is preferably the same as that used for the first linear motor, with the aim of minimising as much as possible the number of kinematic components required for operation of the device 1.

Thus, here also, activation of the solenoid fitted to the primary mobile component 72 of the linear motor 70 creates electromagnetic forces which provide, on the one hand, movement of the third carriage 60 in direction X on the rails 20 and on the other hand an attraction along direction Z between this same carriage towards a fixed secondary component 28 of the permanent magnet type track.

In order to also achieve micrometric precision in the movement of the carriage 60, it is envisaged that the latter be equipped with a reading head 74, which fits onto the aforementioned optical rule 32 placed on the chassis 2. This means that it is therefore possible to achieve complete control over the relative separation of the two carriages 10 and 60, which offers the advantage of giving better control over the depth of the holes and countersinking made using the drilling tool.

Figure 4:
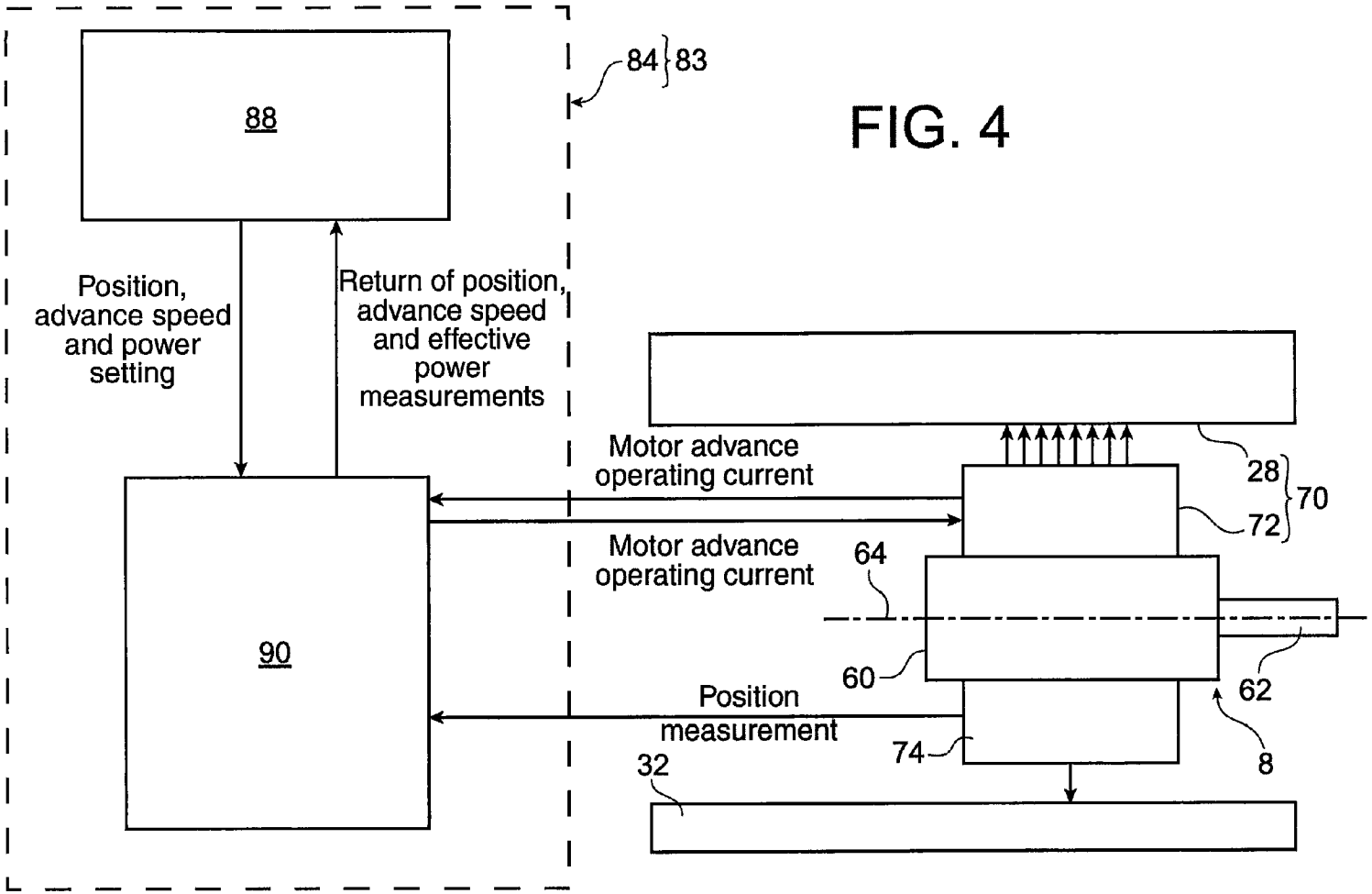
FIGS. 4 to 6 represent schematic views of various parts of a control system fitted to the device shown in FIGS. 1 to 3.
Figure 5:
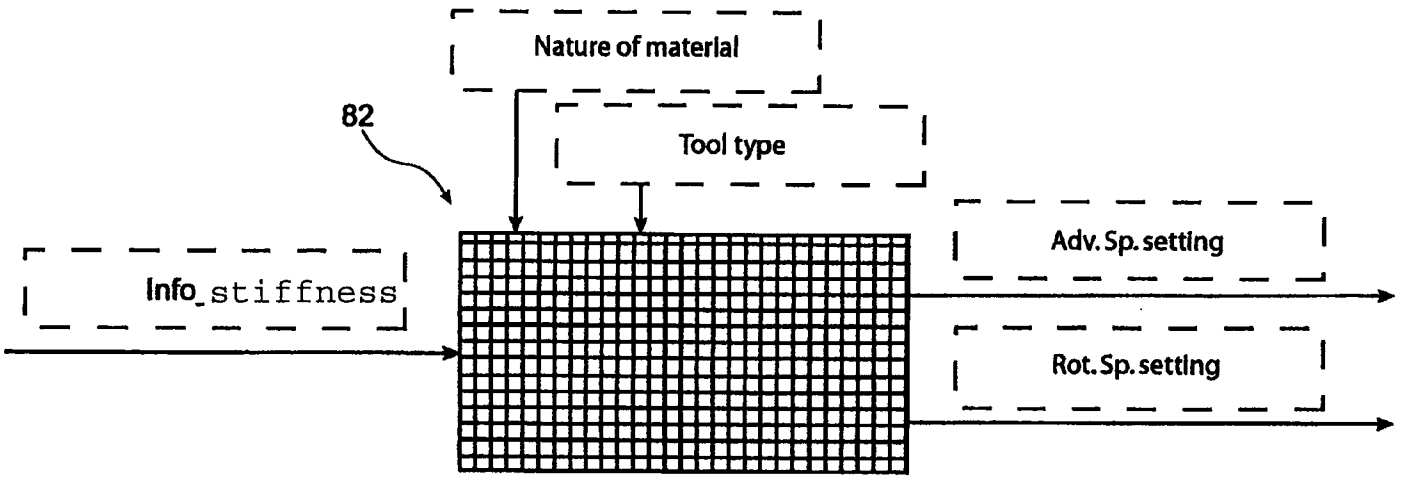
Figure 6:
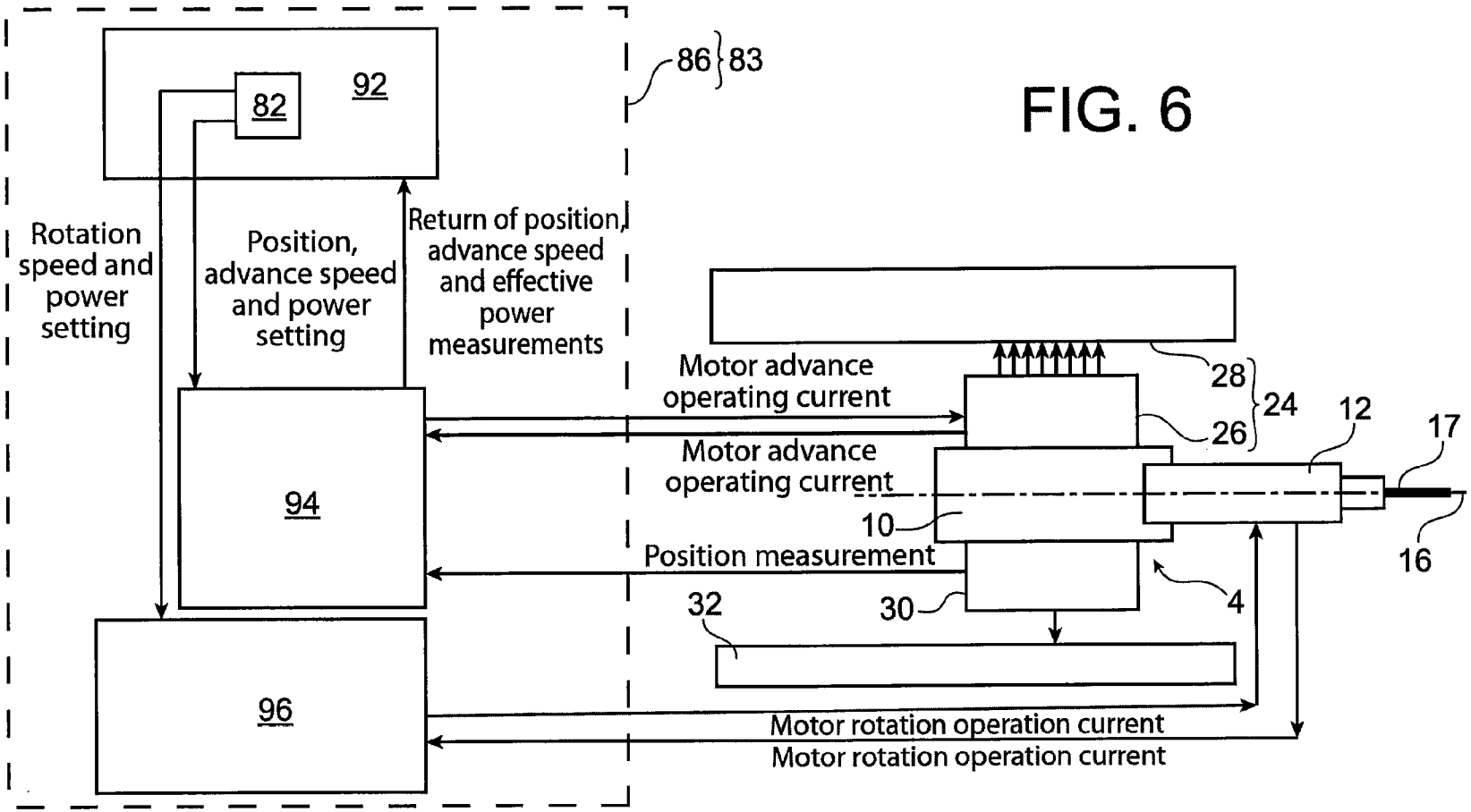

In order to operate this device 1 in the desired manner, it is also equipped with a control system 83 shown schematically in FIGS. 4 to 6. Overall this system 83 includes a first means of control 84 associated with the hold-down system 8, together with a second means of control 86 which is associated with the drilling system 4, with these means 84, 86 naturally being capable of being combined within the same item of equipment.

As far as the first means 84 shown in FIG. 4 are concerned, these include a first digital control unit 88 connected to a control board 90 for the linear motor 70 for the hold down system 8. The unit 88 is therefore capable of delivering instructions for position, speed of advance and power to the board 90, which then carries out a servo-control of position, speed of advance and power, by supplying an appropriate level of power to the motor 70 to which this board 90 is connected.

In return the servo-control board 90 receives information from the reading head 74 on the actual position of the carriage 60, with this information being sent to the unit 88. In addition this servo-control board 90 is also capable of sending measurements to the unit 88 which relate to the speed of advance of the carriage 60 and the effective power, where this effective power allows the unit 88 to determine the motor power passing through the system 8 during the approach and clamping operations.

As far as the second means 86 shown in FIG. 6 are concerned, these include a second digital control unit 92 connected to a servo-control board 94 for the linear motor 24 for the hold down system 4. The unit 92 is therefore capable of delivering instructions for position, speed of advance and power to the board 94, which then carries out a servo-control of position, speed of advance and power, by supplying an appropriate current to the motor 24 to which this board 94 is connected. In return the servo-control board 94 receives information from the reading head 30 on the actual position of the carriage 10, with this information being sent to the unit 92. In addition this servo-control board 94 is also capable of sending measurements relating to the speed of advance of the carriage 10 and if necessary the effective power to the unit 92.

Furthermore, the digital control unit 92 is also connected to a servo-control board 96 for the rotary motor for the spindle 12. The 92 is therefore capable sending rotation speed and power settings to the board 96, which then carries out a servo-control of rotation speed and power, by supplying an appropriate current to the rotary motor to which this board 96 is connected. In return, it could if necessary be envisaged that this servo-control board 96 sends the unit 92 measurements relating to the rotation speed of the tool 17 and effective power.

In this respect it should be indicated that the unit 92 includes means 82 which enable the delivery, to boards 94 and 96 respectively, of advance speed settings for the tool and speed of rotation settings of the tool which are a function of the information on the local stiffness of the panels at the hole which is destined to receive a rivet, with this information being given the name Info_stiffness.

More specifically with reference to FIG. 5, it can be seen that these means 82 take the form, for example, of a correction matrix for the two aforementioned settings, this matrix therefore taking into consideration not only the Info_stiffness information determined earlier, but also as appropriate the nature of the material and the type of drilling tool, data for which is pre-recorded in a specific programme. Naturally this correction matrix is designed so that the advance and rotation speed settings that is issues to boards 94 and 96 allow drilling to be carried out with as high a level of quality as possible.

The process for assembling using riveting which uses the device 1 described above will now be described with reference to FIGS. 7*a* to 7*f*, where this process overall includes a step for determining information on the local stiffness of panels at a hole to be drilled, followed by a drilling step whose purpose is to create the hole, together with the countersinking associated with it, mien finally a step for fitting a rivet in the aforementioned drilled hole, with these three steps being repeated for each rivet to be fitted in the panels to be assembled.

Figure 7A:
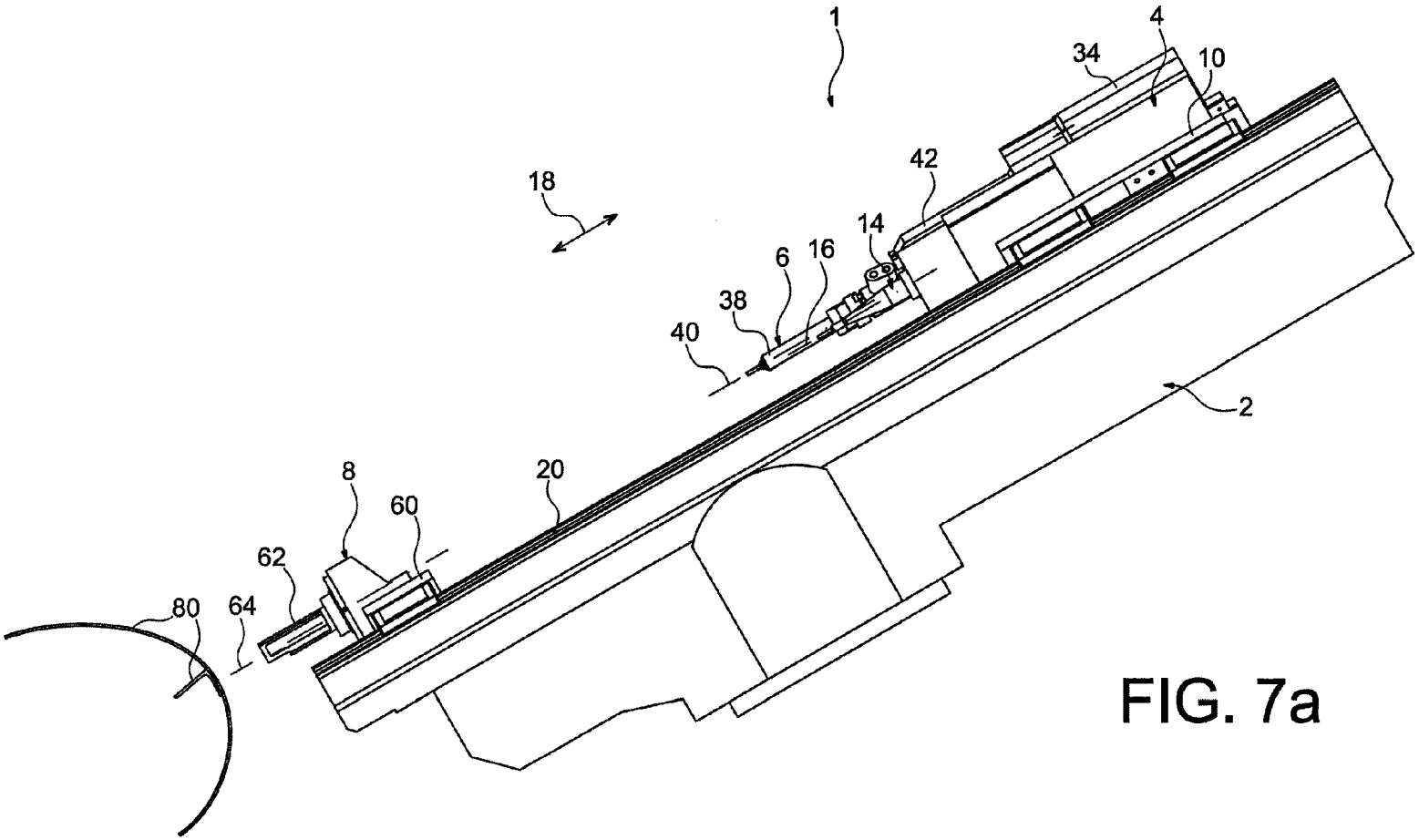
FIGS. 7*a* to 7*i* show the device in FIGS. 1 to 3 at different stages during the operation of a process for assembling panels using riveting in accordance with one preferred mode of construction of the present invention.

As shown in FIG. 7*a*, the chassis is first of all positioned in relation to the panels 80 to be assembled depending on the point in these where the rivet is to be placed, with all three systems 4, 6 and 8 being in their at-rest position.

Figure 7B:
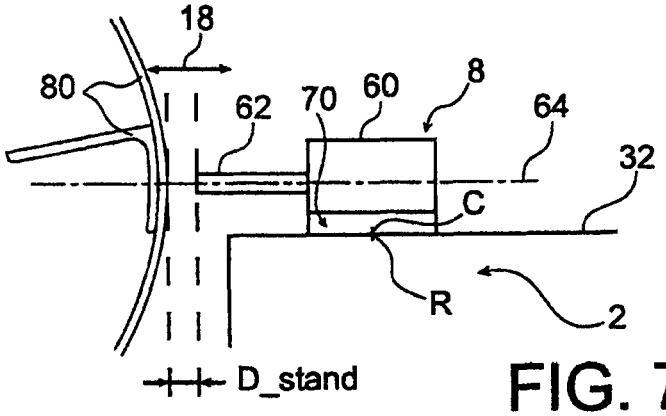

More precisely, with reference to FIG. 7*b*, it can be seen that the chassis 2 is first of all brought by the robot arm close to the panels 80 to be assembled, so that the front end of the hold-down head 62 is located at a standard distance D_stand from the panels 80 along the slide direction 18 and the direction of the axis 64, where this distance may be of the order of 15 mm. At this stage the carriage 60 is in a position such that its central point C is located at a set point R on the optical rule 32.

Then the approach operation is initiated by commanding linear movement of the carriage 60 using the unit 88, in order to achieve contact between the head 62 and the panels 80. It should be noted that as soon as the aforementioned contact is established, the control unit 88 periodically determines the motor power value P1_absorbed passing through the system 8, where this value P1_absorbed is then converted by a converter incorporated in the unit 88 in order to obtain a value of the resistance force of the panels at approach F1. As an indication, it should be noted that this force F1, updated every 5 ms, also corresponds in value to a depression force exerted by the hold-down system 8 against the panels 80.

Figure 7C:
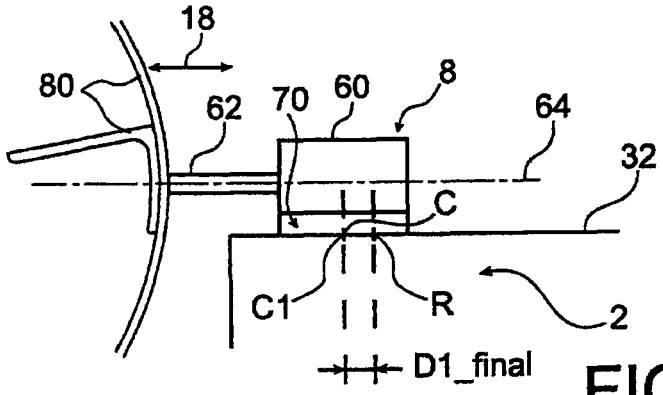

The control of this approach operation is envisaged to be such that movement of the system 8, and more specifically that of its carriage 60, occurs when the determined force F1 reaches a target value F1_target, which may be for example set to a low value of the order of 1N. As shown in FIG. 7*c*, at the end of the approach operation, the carriage 60 has therefore covered a distance D1_final between the point R and a point C1 on the rule 32, where point C of carriage 60 is located, with the value of this distance F1_final measured using the rule 32 being sent to the unit 88. In addition, at this moment, the resistance force of the panels at the end of the approach, referred to as F1_final is known and recorded using the unit 88 and this is, of course, effectively the same as force F1_target.

Furthermore, an error can also be detected using the value of the distance D1_final that is recorded. In effect, if this value is not within a predetermined range, one may then conclude that the device is incorrectly positioned in relation to the panel, or that the panel shape is outside tolerances.

The clamping operation is then initiated and this is started as soon as the approach operation is complete, possibly with a stoppage time between these two operations. In a matter which is identical to that which encountered in the context of the previous operation, clamping is carried out by sending a command for linear movement of carriage 60 using unit 88 in order to obtain enhanced adhesion in contact between the head 62 and the panels 80. It should be noted that during this operation the control unit 88 periodically determines, on the one hand the value of the motor power P2_absorbed passing through the system 8, where this value P2_absorbed is then converted by the converter in order to obtain a value of the force of resistance of the panels at clamping F2, and on the other hand the clamping distance D_clamping which corresponds to the actual distance travelled by point C of the carriage between the point on the optical rule 32 where it is at the moment t in question, and point C1 on this rule. Here once again it should be stated that the force F2, updated every 5 ms, as is the value C_clamping, also corresponds in value to a depression force for the hold-down system 8 against the panels 80.

The control of this clamping operation is envisaged such that the movement of the carriage 60 occurs when the determined force F2 reaches a target value F2_target, or once the clamping distance D_camping has reached a target value D_clamping_target, with the clamping operation therefore taking place when either of these two target values is reached.

Figure 7D:
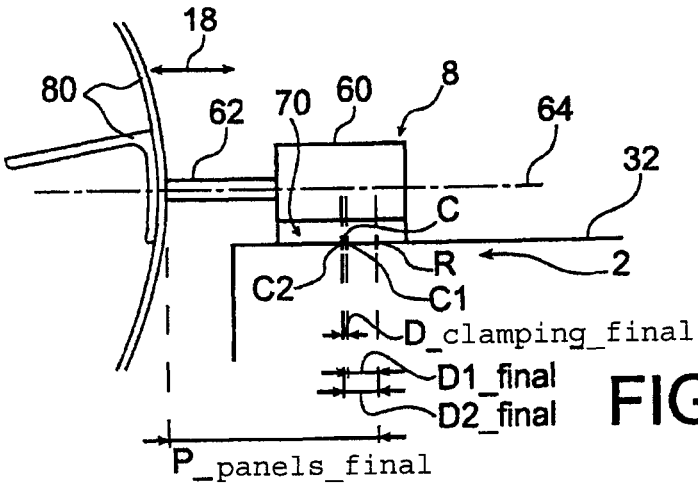

As an indication, the target value F2_target may be fixed, for example, at a value of the order of 150 N, and the target value D_camping_target may be fixed, for example, at a value of the order of 500 μm. As shown in FIG. 7*d*, at the end of the clamping operation, the carriage 60 has therefore travelled a distance of D2_final between point R and a point C2 on the rule 32 where point C of carriage 60 is located, with the value of the distance D2_final as measured using the rule 32 being sent to unit 88. This then allows the final clamping distance D_clamping_final actually travelled by the system 8 to be obtained by subtracting D1-finale from D2_final. Furthermore knowledge on the one hand of the dimensions of the system 8 and on the other hand of the actual position of the latter on chassis 2 at the end of the clamping operation allows the exact position of the constrained panels 80 to be determined relative to the chassis 2. In this respect, the unit 88 may then determine and store the distance T_panels_final which corresponds to the distance along direction 18 between the point R of rule 32 and the forward end of the hold-down head 62 at the end of the clamping operation.

This specific feature is advantageous since it allows the linear movement of the drilling system 4 during the next drilling step to be optimised as much as possible, insofar as this system 4 may be operated at high speed over a precise fixed distance as a function of the distance T_panels_final, before being slowed to the advance speed for the tool determined beforehand. In addition, knowledge of this distance T_panels_final, of the order of 200 mm, is used to precisely fix the distance for the change of rotation speed of the drilling tool for the countersinking approach, when a staged drill-countersink tool is used. Finally another advantage rests in the fact that the depth of the countersink can be in full compliance with requirements. In this respect it should be indicated that the subsequent countersinking travel may also be corrected as a function of the Info_stiffness information determined as described below, and also if necessary as a function of the various characteristics of the rivets employed. In this respect it should be noted that the lower the local stiffness of the panels, the more these are deformed by the thrust of the hold-down head, and therefore the further the centre of this hold-down head is away from these same deformed panels. Thus, the lower the local stiffness of the panels, the greater the countersink travel relative to the hold-down system that is required to obtain a determined countersinking depth.

Furthermore, errors can also be detected using the value of the distance D1_clamping_final that is recorded. In effect, if this value is not within a predetermined range, one may then conclude that the device is incorrectly positioned in relation to the panel, or that the panel shape is outside tolerances. Furthermore, at the end of the clamping operation which is stopped when the target value D_clamping_target has been reached, the value of the resistance force of the panels at the end of clamping, known as F2_final is known and recorded. If this value is too low, the structure formed by the panels may be considered not to be present.

Using the panel resistance force value at the end of clamping F2_final it is then possible to determine, again using the unit 88, the Info_stiffness information by establishing the following ratio:

$$\text{Info_stiffness}=(F2_\text{final}-F1_\text{final})/D_\text{clamping_final}$$

This information on the local stiffness of the panels, the value of which is, for example, of the order of 30 kg/mm, is then sent to the second means of control 86, associated with the drilling system 4, and more specifically to the correction matrix 82 with which the unit 92 is equipped. As indicated previously, this info_stiffness information is envisaged as pre-assigning the advance speed and rotation speed settings of tool 17 used during the control of the drilling step which will now be described.

Figure 7E:
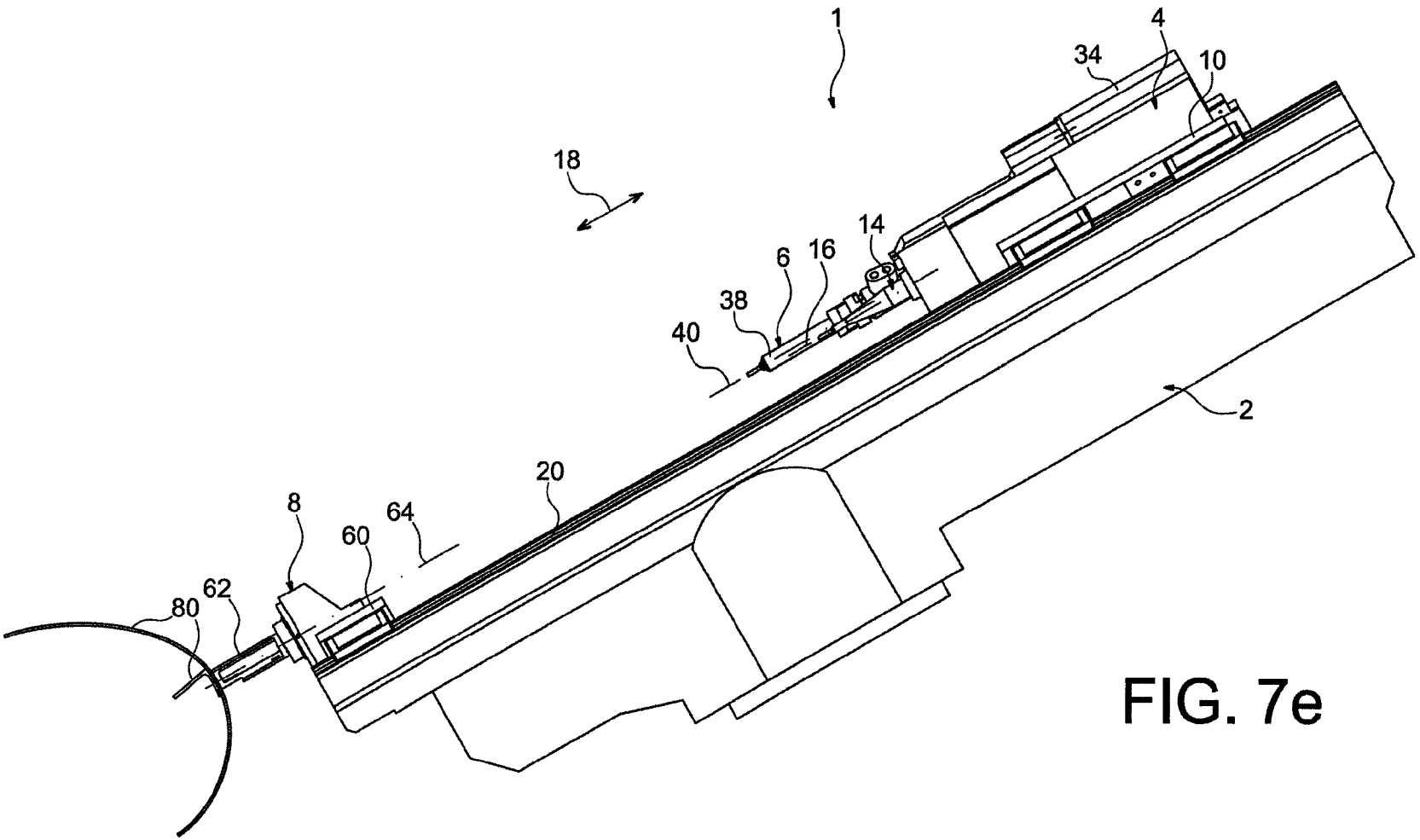

First of all it should be stated that this drilling step is initiated with system 8 in the position as shown in FIG. 7*d*, and systems 4 and 6 in their positions as shown in FIG. 7*a*, as shown overall in FIG. 7*e*.

This drilling operation involves setting carriage 10 of the drilling system 4 in motion, so that it passes through the hold-down system 8, and also passes through the two panels to be assembled.

Figure 7F:
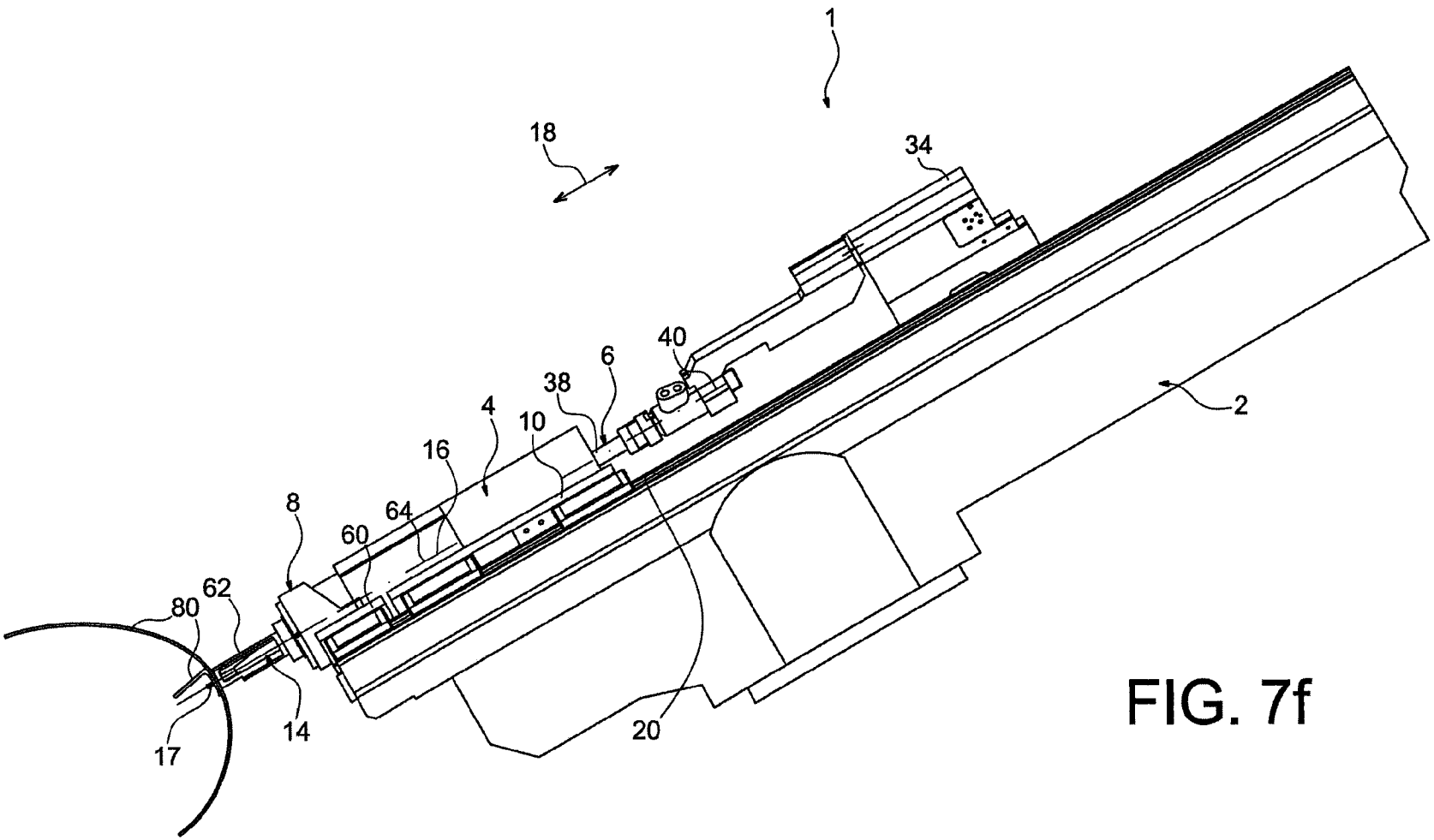

The required advance in the slide direction 18 is achieved using the first motor 24. On this point it should be noted that this operation preferably aims not only to make a hole through the two superimposed panels 80, but also to make a countersink which is designed to house the head of the rivet which will be later put in place. As shown in FIG. 7*f*, it should be noted that setting carriage 10 of the drilling system in motion along direction 18 does not result in any movement of the carriage 34 of the riveting system 6, given that this operation has been carried out with the brake callipers 54 in a deactivated state, that is, without the brake callipers 54 being firmly fixed to the rail 52. Consequently it should be noted that during the movement of the first carriage 10, the second carriage 34 remains immobile relative to the chassis 2.

More precisely, drilling is carried out by ordering the linear movement of the carriage 8 using the tool advance speed setting as determined beforehand and issued from the matrix 82, and by simultaneously commanding rotation of the spindle 12 using the tool rotation speed setting also coming from the matrix 82, with these settings being issued respectively to servo-control boards 94 and 96.

During this drilling step the value of the pane: resistance force F3 which results from the hold-down system 8 pressing on the panels 80 is periodically determined. This determination of F3 is preferably carried out in the same manner as that used for the determination of F1 and F2. In this respect it should be indicated that the motor associated with the carriage 60 of the hold-down system continues to be supplied during drilling, and that it is servo-controlled in position so that carriage 60 retains its position at C2 on the chassis 2.

As an indication, F3 is updated every 5 ms and its value corresponds to a depression force for the hold-down system head 62 against the panels 80 during drilling.

This then allows the value of this force F3 to be periodically compared during drilling by unit 92 with a minimum value F3_min, where the minimum value F3_min may be, for example, set at 5 N.

When F3 is detected as being less than F3_min, a reduction in the drilling tool advance speed setting is made via matrix 82, so that the value of the force F3 returns above the minimum value F3_min. This method of operation thus advantageously means that the hold-down head 62 does not lose contact with the panels during the drilling operation, following the drilling tool 17 exerting excessive thrust on these panels.

Figure 7G:
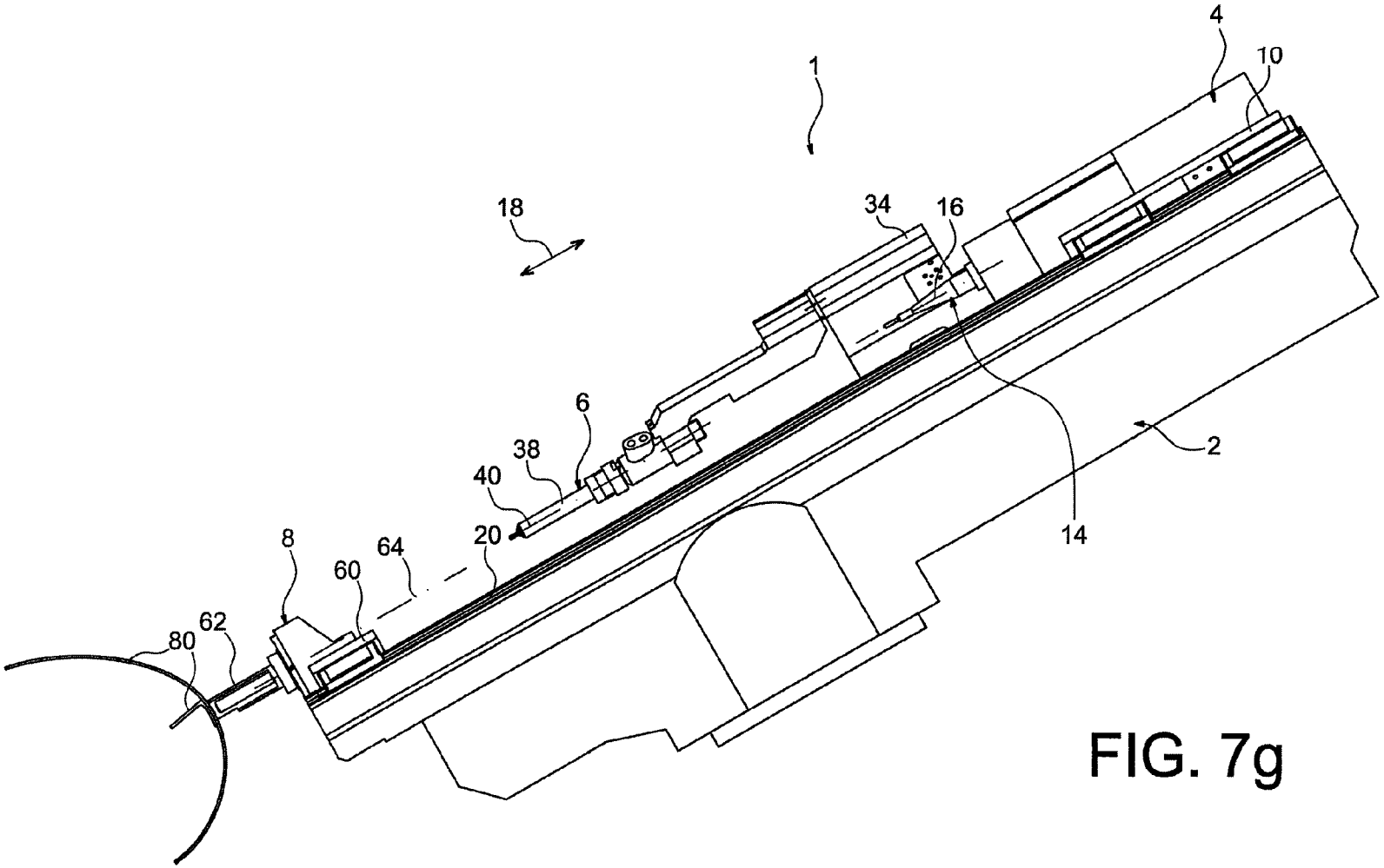

At the end of this drilling step, as shown in FIG. 7*g*, the carriage 10 is one again operated in such a manner that it reverses along the rails 20 until it reaches a position which is further away than the start position shown in FIG. 7*a*. In effect, a relative separation is sought in direction 18 between the carriage 34 and the carriage 10 so that the riveting head 38 may pass in front of the drilling head without any difficulty in clearance, as will be described later.

The process is then continued by a step in which a rivet is placed in the hole that has been made, where this step starts with a movement of the riveting head 38 along the drilling head axis 14, in front of the latter.

Figure 7H:
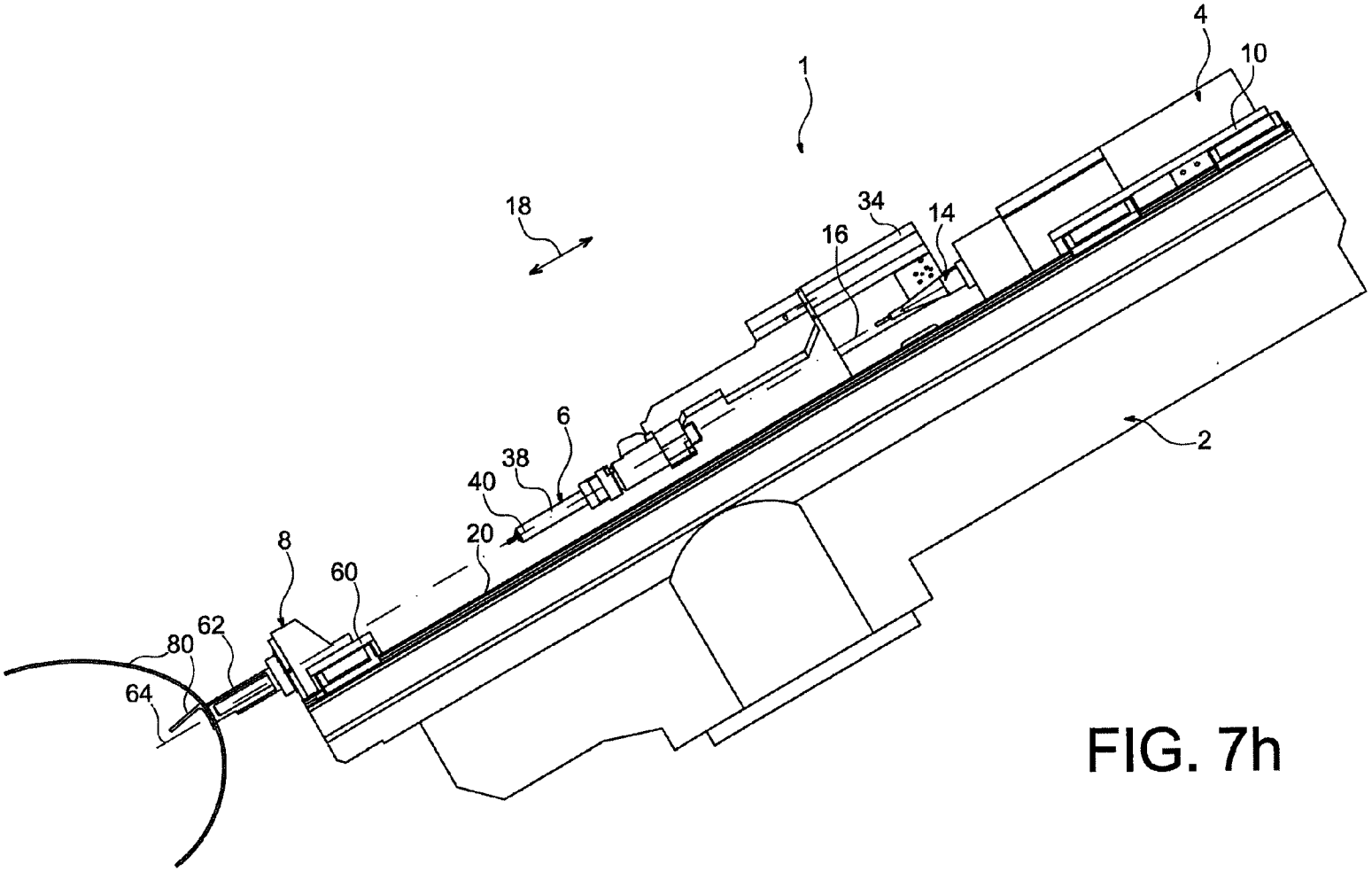

In order to align these two axes 16, 40 and therefore ensure that the riveting head 38 is in the working axle, the means for initiation rotation of this head 38 and of the arm 42 are activated until the desired position is achieved, as shown in FIG. 7*h*. Parallel to this the means of coupling 50 of the two carriages 10 and 34 are operated so as enter the activated state, allowing them to be coupled in a translation movement in direction 18.

Figure 7I:
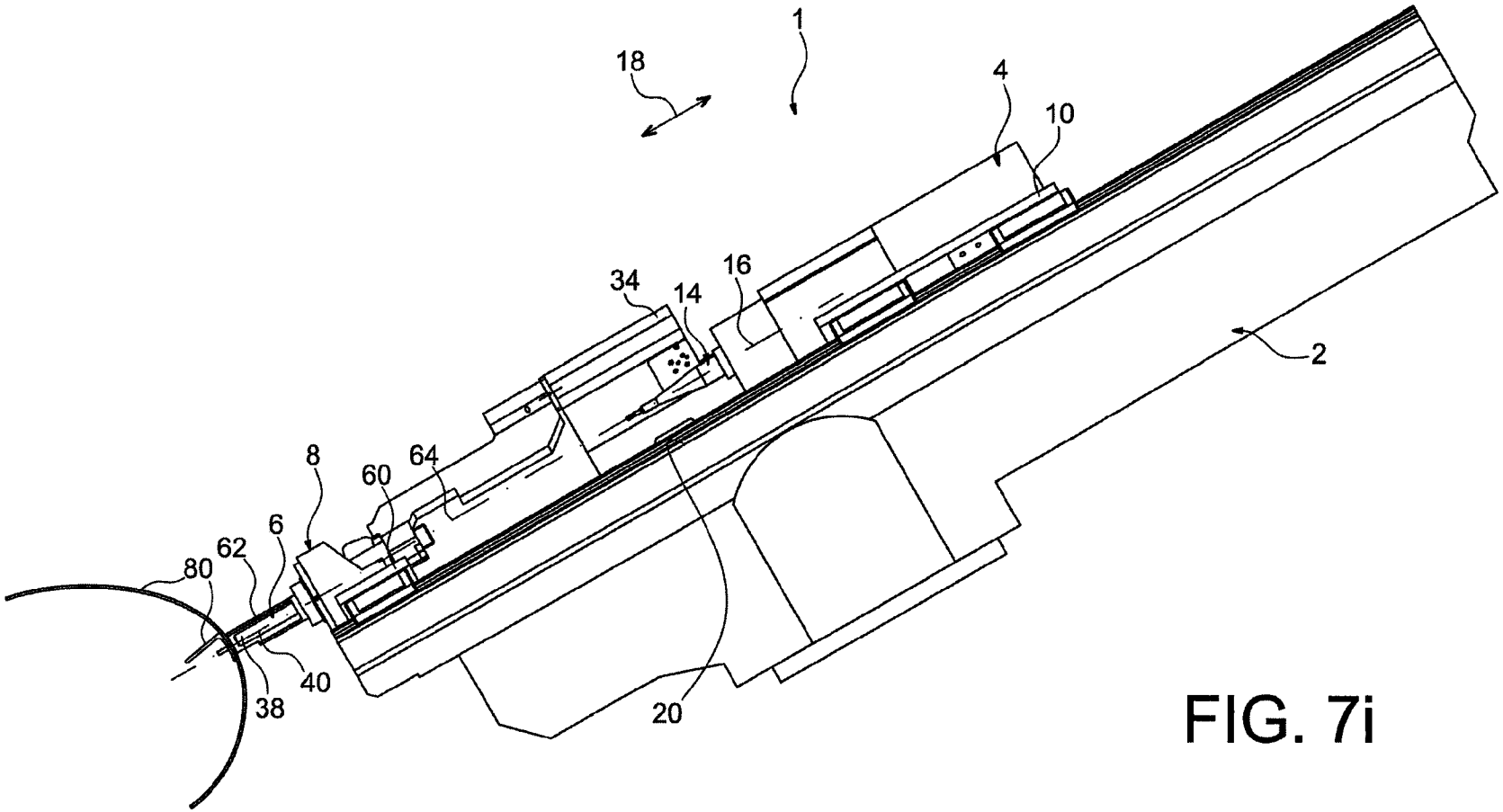

Then a movement of the assembly of the two carriages 10, 34 is undertaken using the first linear motor 24, as can be seen in FIG. 7*i*. During this movement, the riveting head 38 located in front of the drilling head 14 penetrates inside the hold-down head 62 and therefore moves into a position which is very close to the two panels 80 to be assembled and on which the operation for putting the rivets in place is carried out in a conventional manner, familiar to those working in the field.

Once the rivet is in place, the three carriages 10, 34, 60 are operated so that they return to their at-rest positions as shown in FIG. 7*a*.

With reference now to FIGS. 8 to 11, one can see a part of the device 1 for assembling panels using riveting which is in accordance with one even more preferred mode of construction of the present invention. Certain parts of this have the same or similar design to that of device 1 described previously, and in this respect, it should be noted that on the diagrams those elements which have the same numerical references correspond to identical or similar elements. Consequently, it can be perceived that the notable difference between the two devices 1 is due to the design of the riveting system 6, and more specifically to the design of the means for setting the riveting head 38 in motion relative to the second carriage, again designed so that it can move the same riveting head between the at-rest position in which the drilling head axis and the riveting head axis 16, 40 are distinct, and a working position in which the drilling head axis and the riveting axis 16, 40 coincide. However, the chassis 2, the drilling system 4 and the hold-down system 8 are identical or similar to those described earlier.

Figure 8:
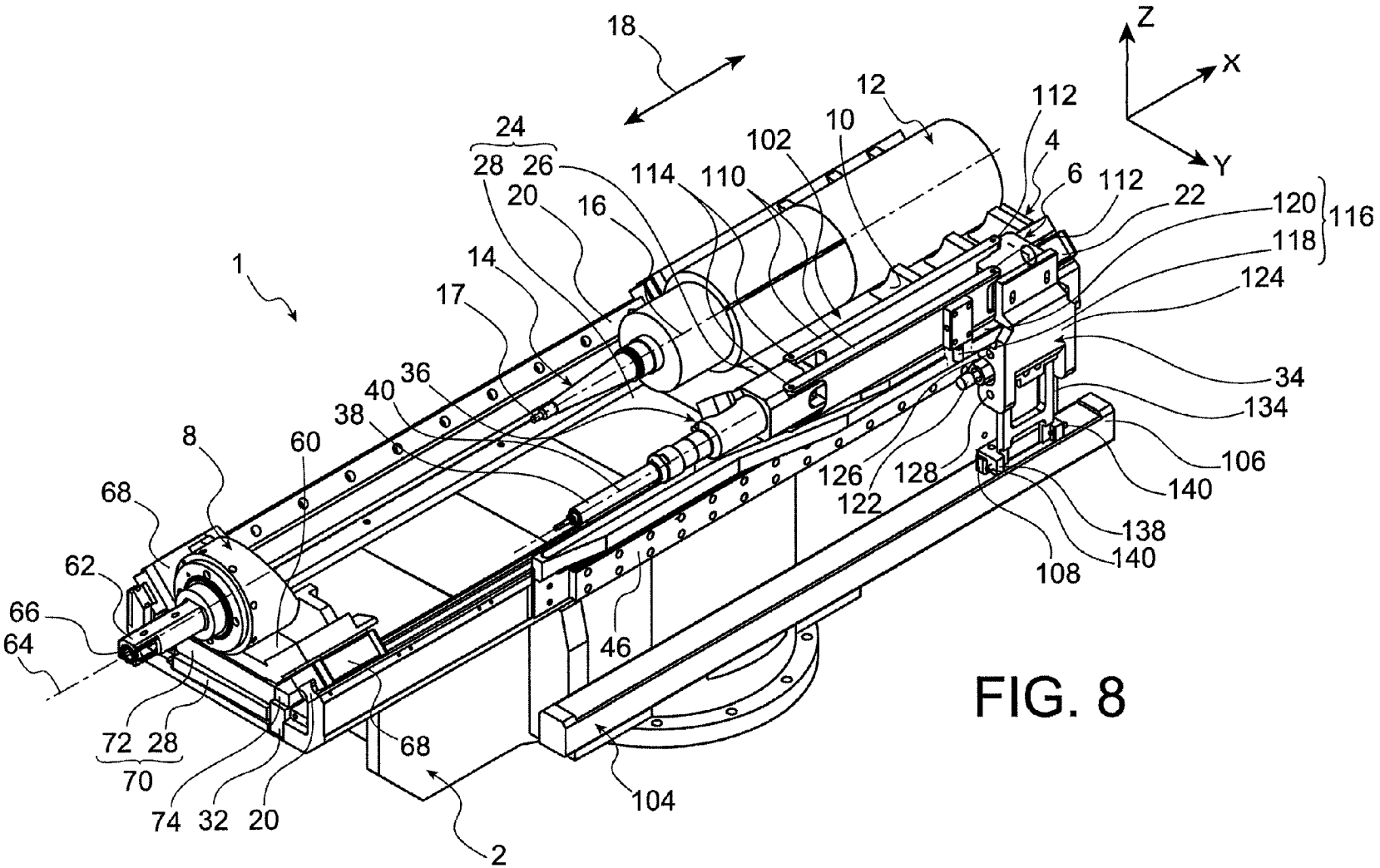
FIG. 8 represents a perspective view of a part of a device for assembling panels using riveting which is in accordance with another preferred mode of construction of the present invention.
Figure 9:
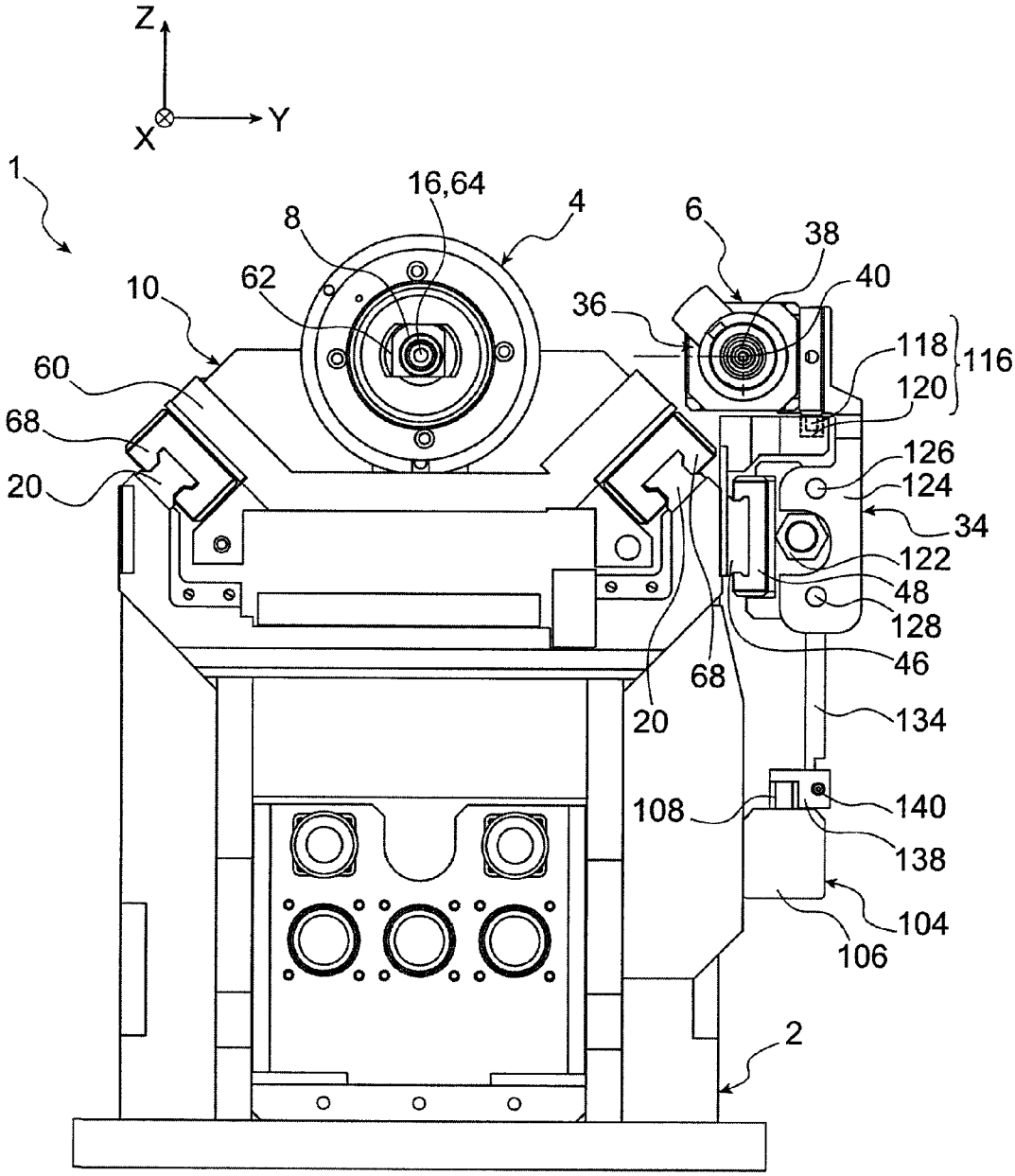
FIG. 9 shows a front view of the device shown in FIG. 8.

More particularly, with reference to FIGS. 8 and 9, the riveting system 6 includes the second carriage 34 which supports entire riveting tool or riveter assembly, the front part of which includes a riveting head 38, which in turn defines a riveting head axis 40 which is parallel to directions X and 18. The riveting head 38, and more generally the riveting tool assembly 36, is mechanically mounted at its rear part onto the carriage 34 through a parallelogram 102 whose shape can be changed and which will be described below.

The second carriage 34 is, for its part, fitted to the chassis 2 so that it may slide in a rectilinear manner relative to the latter in the slide direction 18. To do this the second carriage 34 is mounted so that it slides on a guide rail 46, preferably distinct from the two guide rails 20 of the carriage 10, but also aligned along directions X and 18. As shown in FIG. 9, the rail 46 with a transverse section in the form of an H is firmly fixed to a lateral external surface of one of the arms of the U formed by the chassis 2.

In order for it to be secured on the rail 46, the carriage 34 is equipped with one or more bearing pads 48 in the form of a calliper, for example in a set of two, spaced out along direction X. Each of these pads 48 therefore presses against the free side arm of the H which is opposite the other side arm which is firmly fixed to the chassis 2.

The riveting system 6 preferably also includes means for setting the second carriage 34 in motion along the slide direction 18, with these means therefore preferably being distinct from the means 24 for setting the second carriage 10 in motion, although the latter could be different without the limits of the invention being exceeded. The means for setting the second carriage 34 in motion preferably takes the form of a rodless cylinder 104, of a type readily available on the market, arranged along direction 18. Overall, this is fitted with a hollow body 106, fixed in relation to the chassis 2, and a moving sliding contact 108, which is able to move along direction 18 relative to the hollow body 106 in which it is partly housed.

As mentioned earlier, one of the noteworthy special features of this preferred mode of construction is due to the presence of the parallelogram whose shape can be changed 102 creating the mechanical junction between the rear part of the riveting tool 36 and the carriage 34. This parallelogram 102 therefore forms an integral part of the means for setting the riveting head 38 in motion relative to the second carriage, given that the latter is easily capable of causing this same riveting head 38 to move between the at-rest position and the working position.

To do this the parallelogram 102 is made up of two parallel arms 110, each of which is articulated at its rear end to the second carriage 34 along an axis 112, and is articulated at its front end on the rear portion of the riveting tool 36 along an axis 114, and more precisely articulated on a support block of the riveting head 38. In this respect, the axes 122, 114 are arranged in parallel to direction Z, so that the parallelogram 102 changes its shape in a plane XY parallel to the slide direction 18. Furthermore, it should be noted that the other two sides of the parallelogram 102 are in material terms formed by the second carriage 34 and the riveting tool.

To supplement the means for setting the riveting head 38 in motion, a mechanical system for changing the shape of the parallelogram is envisaged. This system is designed overall so that when the second carriage 34 is set in motion along a slide direction 10 by means of the cylinder 104, a change in shape of the parallelogram 102 is automatically produced, from a first configuration shown in FIGS. 8 and 9 which places the riveting head 38 in its at-rest position away from the working axis, to a second configuration which will be described later and which places this head 38 its working position.

To do this the mechanical system for changing shape 116 takes the form of a guide system which includes a pin or roller 118 firmly attached to one of the two parallel arms 110, preferably the arm located furthest towards the exterior as shown, where the pin 118 slides in a guide slot 120 when the second carriage 34 is set in motion in the direction 18. The fixed slot 120 on the chassis 2 is preferably located in a plane which is parallel to that in which it is envisaged that the parallelogram is to change shape.

Thus the slot 120, details of which will be given later, has an appropriate shape which ensures that the desired change of shape of the parallelogram takes place, namely which enables a controlled approach of the riveting head 38 towards the device's working head, and which in addition ensures that the riveting head axis 40 is always parallel to direction 18 during movement of this head 38.

Figure 10:
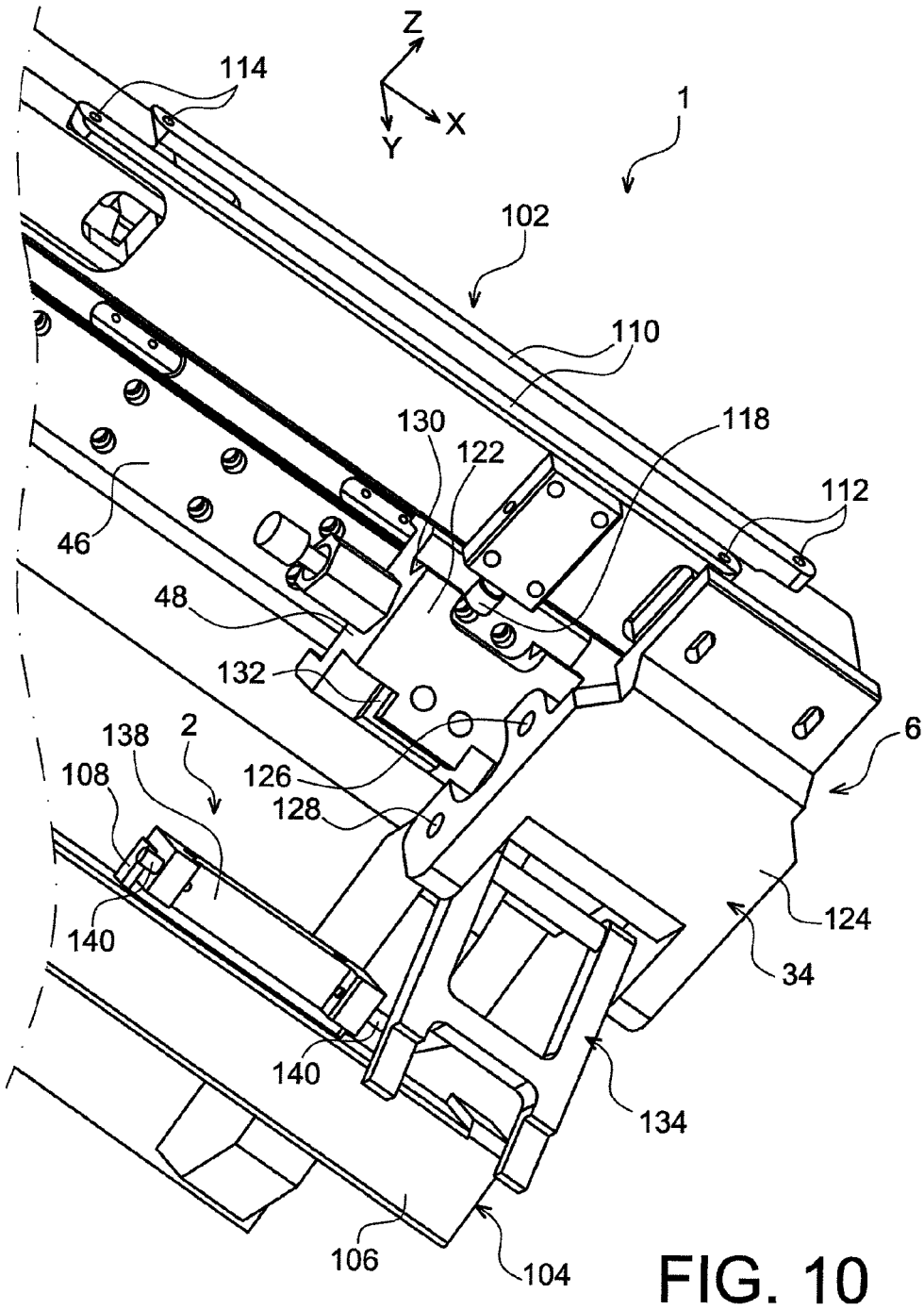
FIG. 10 represents a perspective exploded view of a pert of the device shown in FIGS. 8 and 9, detailing more specifically the design of the second carriage carrying the riveting head.

With reference to FIG. 10, it can be seen that the carriage 34 may be made up of several components which may quickly be dismantled from each other. In effect the carriage part 122 which firmly holds the pad 48 which is in the form of a calliper in position and which fits against the guide rail 46, is designed to remain permanently on this rail whilst another part of the carriage 124 which holds the parallelogram 102 is designed to be mounted using quick attachments to the aforementioned part 122. In other terms, the part 124 is a key interface component whose function is rapid fitting and removal of the parallelogram 102. Overall it is made up of two axes or shafts 125, 128 located one above the other and parallel to the direction X. These two axes 126, 128 are respectively designed to rest in a V-shaped slot 130 and a U-shaped slot 132 made in the component 122 directly fixed to the pad 48.

On the other hand, the carriage 34 is also equipped with a component 134 which forms a mechanical junction between the component 124 and the sliding contact 108, where this component 134 in reality has two distinct functions. The first function involves securing the component 124 onto component 122, namely to ensure that each of the two shafts 126, 128 fit into their respective slots 130, 132. This is simply achieved by rotating the lower shaft 128 carrying the junction component 134, where the said shaft has an eccentric shape designed for this purpose. More precisely, the shaft 128 is introduced in the first instance fully into the U-shaped slot 132, then shaft 126 is tipped to the vertical for the V-shaped slot, and finally the component 134 is thrust by pivoting against a component 138 which will be described below. Locking is simultaneously achieved by the eccentric support of the junction component 134 against the slot 132.

The second function is due to mechanical coupling with the cylinder slide contact 108. In effect, the H-shaped component 134 couples quickly at the two lower arms of the H between the forks of a receiving U-shaped component 138 bolted onto the sliding contact 108. To do this, the U-shaped component 138 holds spring ball screws 140 for retaining the two lower arms of the H in a closed/locked position, thus ensuring that there is an end-stop for the H-shaped component 134 which plays a part in the mechanical coupling of the carriage 34 onto the rodless cylinder 104.

Figure 11:
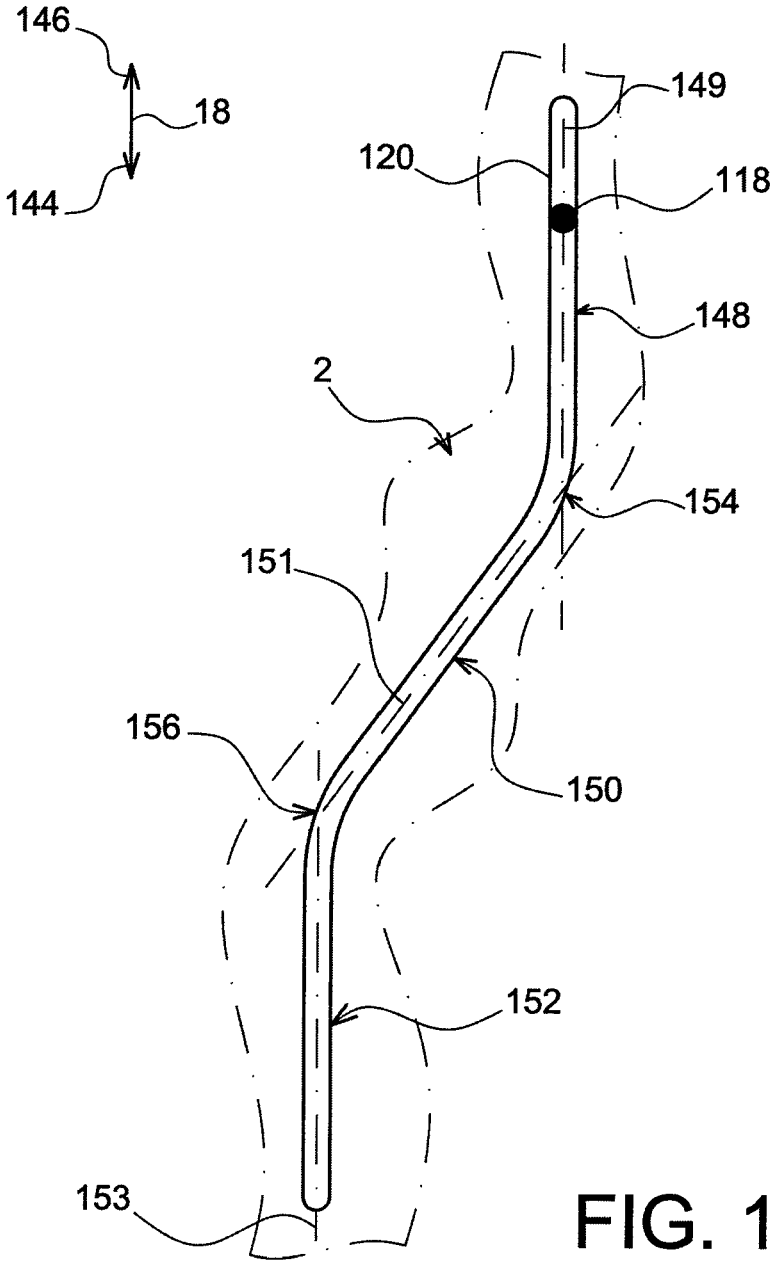
FIG. 11 represents a schematic view from above illustrating the guide slot used to change the shape of the parallelogram whose shape can be changed which is fitted to the device shown in FIGS. 8 to 10.

FIG. 11 shows a view from above of the guide slot 120 in which the pin 118 is designed to slide when the carriage 34 is set in motion in direction 18. First of all it can be seen that in the first direction 144 of the slide direction 18, oriented towards the front of the device 1, this slot 120 is made up of three distinct portions which are connected to one another. There is a first portion 148 which extends along an axis 149 parallel to direction 18, where, overall, this first portion 148 allows the riveting head 36 to be moved whilst keeping it away from the working axis of the device. In this respect, it should be noted that whilst the pin 118 remains in the first portion 148, the riveting head 38 moves in direction 18 without the position of its axis being changed. Thus it should be understood that the shape of the parallelogram 102 does not change during this part of the movement of the riveting tool 36. The slot 120 then includes a second portion 150 whose function is to produce a gradual change in the shape of the parallelogram 102 until it adopts the configuration which allows the riveting head to be placed in its working position, namely, alignment of the riveting head axis 40 with the drilling head axis 16.

To do this, in the mode of construction that is described, this second portion 150 extends along an axis 151 located in the horizontal plane of the slot 120, and which is inclined in relation to the direction 18 and the axis 149 of the first portion. The slot 120 is then terminated by a third portion 152 which is similar in terms of shape to the first portion 148, giver that it is aligned along an axis 153 which is parallel to direction 18. This third portion is used to maintain the changed shape of the parallelogram and to allow the riveting head 38 to move along the working axis, with the riveting axis 40 parallel to the drilling head axis 16.

In the light of the above it should be noted that the profile of the slot 120 has certain similarities to that of a car driver changing lane, insofar as it changes from a straight path to a gradual displacement to rejoin a new path once more which is offset from the first. Naturally, in order to prevent sudden jerks and to ensure fluid movement of the pin 118, junctions 154 and 156 between the three portions 148, 150 and 152 are designed with a shape that is effectively rounded.

It should be noted that the position of the pin 118 near to the rear end of the exterior arm 110, namely close to the axis of rotation 112, amplifies the offset traced by the second portion 150 of the slot. Typically, since the between-centre distance for the articulations 112, 114 measures 240 mm, and since the distance of the pin 118 to axis 112 is about 30 mm, an amplification ratio of 240/30 is achieved for the offset, that is, eight times the offset made in the slot. Thus with an offset of 24 mm made in the slot, an offset of 192 mm is achieved between the disengagement axis and the work axis.

The process for assembly using riveting that is achieved using the device 1 presented above will now be described.

First of all, it should be stated that this process in overall terms includes the same steps as those indicated in the preceding mode of construction, namely a step for determining information on the local stiffness of the panels at the location of the hole to be drilled, followed by a drilling step whose purpose is to create the hole and the countersink associated with it, then finally a step in which a rivet is fitted in the drilled hole. Since the first two steps are identical to those mentioned earlier, they will not be described in any further detail. However, since the riveting step is effectively different, in particular in the manner in which the riveting tool 38 is brought into the working axis, details of this will now be given.

Figure 12A:
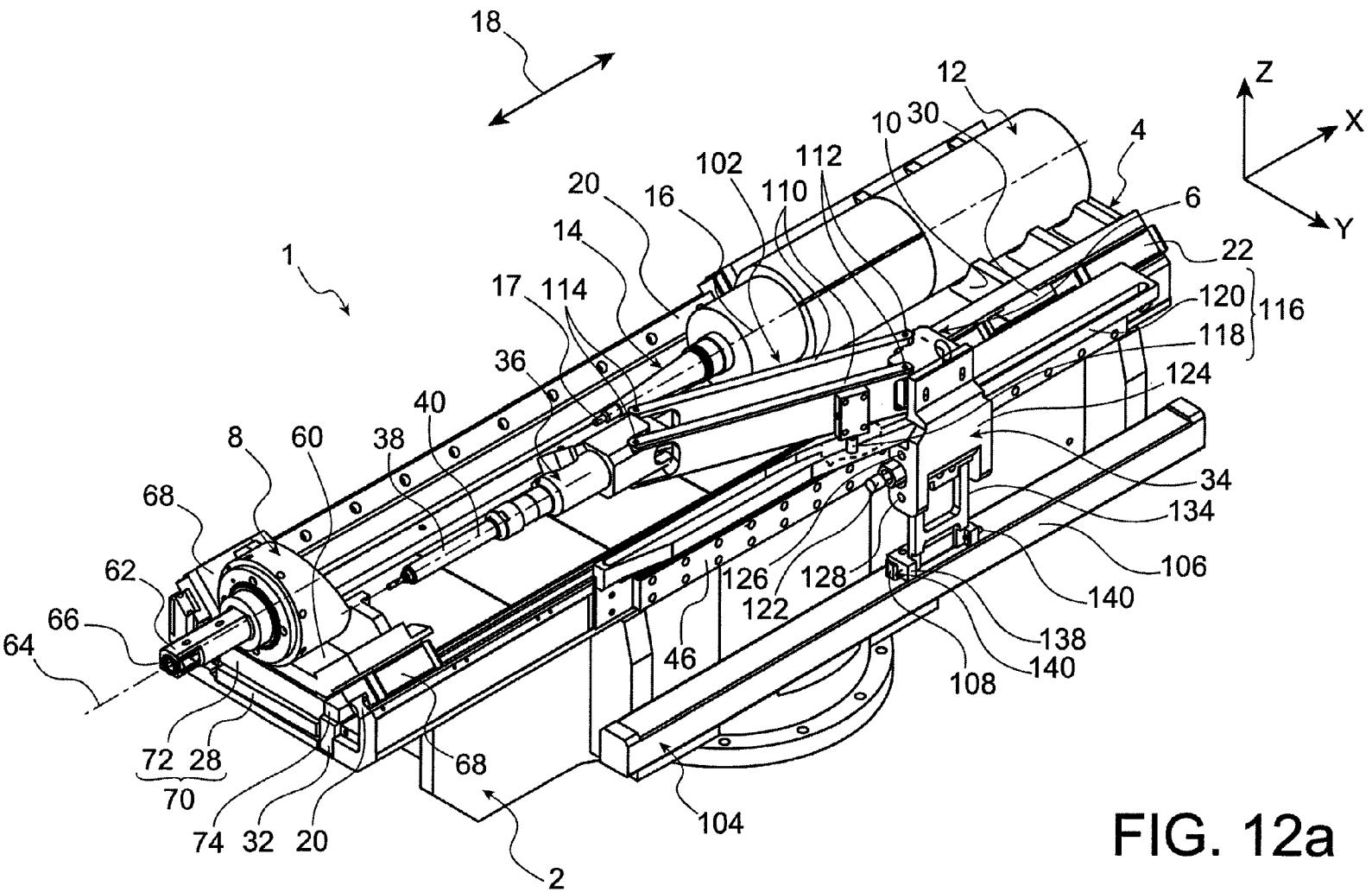
FIGS. 12*a* and 12*b* show the device in FIGS. 8 to 11 at different stages during the operation of a process for assembling panels using riveting in accordance with one preferred mode of construction of the present invention.

With reference to FIG. 8, can be seen that at the end of the drilling operation, the riveting carriage 34 is set in translation movement along direction 18, which means that the pin 118 is set in motion along the first portion 148 of the slot. During this movement, the riveting head 38 is moved forwards in direction 144 of direction 18, with its axis 40 not undergoing any movement because of the parallelogram 102 being maintained in the first configuration. Thus this first part of the movement of the riveting head 38 means that it is maintained in its at-rest position, whilst it moves forwards towards the front of the device. Then whilst the rodless cylinder 104 continues its movement, the pin 118 enters the second portion 150 of the slot, leading to a gradual change of shape of the parallelogram 102 until it achieves the second configuration, in which it places the riveting head 38 in the work axis in order that it may carry out the desired riveting operation. Consequently, as has already been stated above, the riveting head is aligned in the working axis by the change in shape of the parallelogram 102, with this kinematic solution ensuring quick and accurate engagement in the hold-down system designed for this purpose. FIG. 12*a* thus shows the riveting system during the movement of the pin 218 within the second portion 150.

This solely mechanical solution has the benefit of no longer being dependent on a motorised system in order to gradually engage the riveting system, nor on position and control sensors for the automatic control systems associated with the drive. It thus ensures improved engagement of the riveting system within the working axis, since this engagement using a pantograph-type mechanical process is non-conditional, fast, simple and reliable.

Figure 12B:
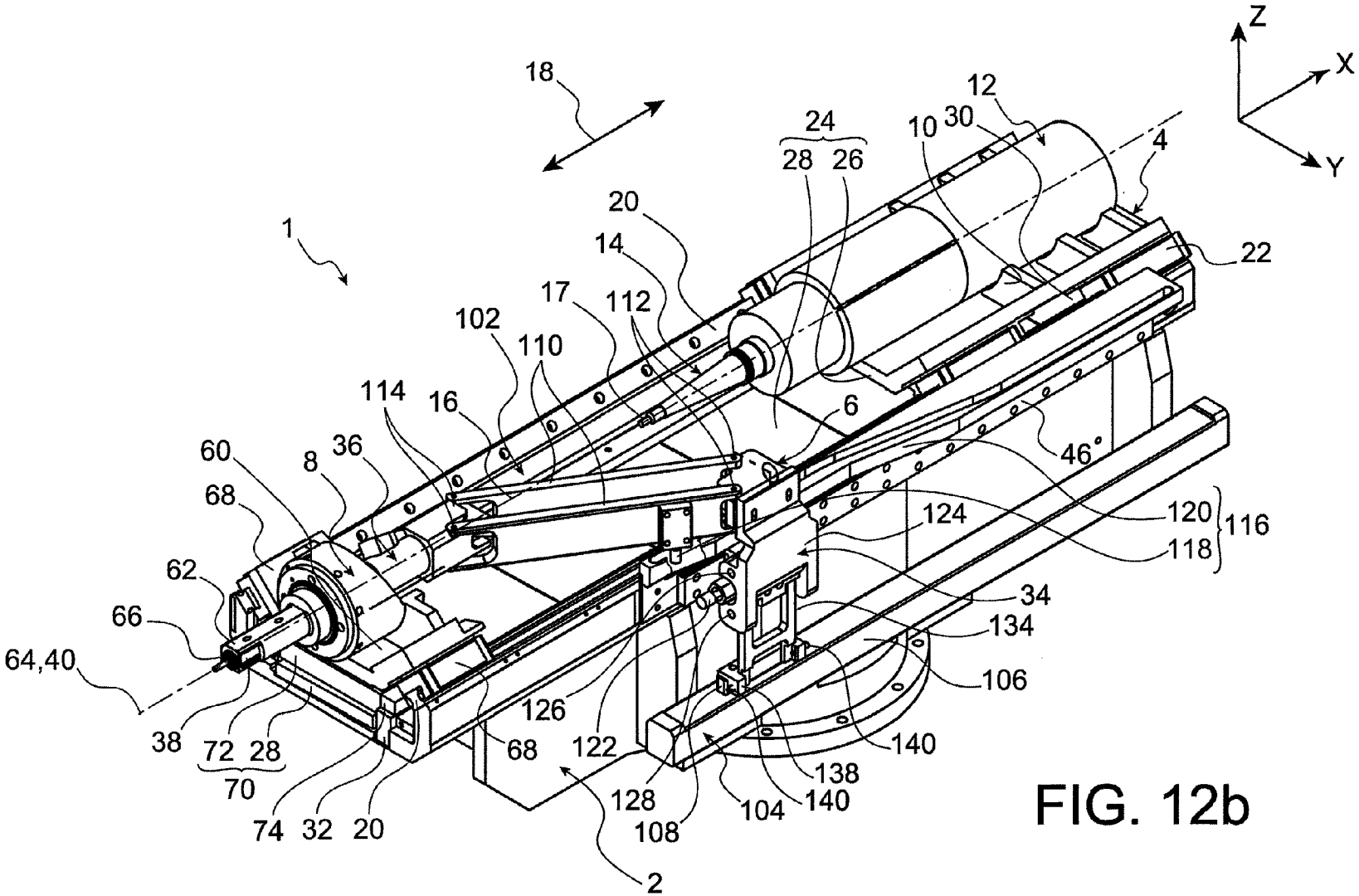

The final part of the advance of the carriage 34, carried out with the pin 118 in the third portion 152, causes the riveting head 38 to move in direction 18, parallel to the working axis, until the rivet is introduced into the drilled hole shown schematically in FIG. 12*b*

Furthermore, at the end of the introduction of the riveting head 38 into the gun 62 of the hold-down system 8, a precise re-centring is carried out, thanks to the tolerancing of the through-hole 66 with the riveting head 38, preferably of diameter 18 H7 g6. Furthermore a tapered lead in to the gun 62 of the hold-down is preferably envisaged.

Once this is achieved, the slide contact 108 of the cylinder 104 may be moved in the opposite direction 246 towards the rear, in order to return the device to the configuration shown in FIG. 8.

Naturally, various modifications can be made by professionals working in this field to the devices 1 and to the processes which have just been described as non-restrictive examples only.

The invention claimed is:

1. Device (1) for assembly of panels (80) using riveting, where the device includes a riveting system (6) together with a drilling system (4), where said drilling system (4) includes a first carriage (10) as well as a drilling head (14) mounted on the first carriage (10) and which defines a drilling head axis (16), and where said riveting system (6) includes a second carriage (34) as well as a riveting head (38) which is mounted on the second carriage (34) and which defines a riveting head axis (40), wherein the device additionally includes means for setting said riveting head (38) in motion relative to the second carriage (34), designed to be capable of moving this same riveting head (38) between an at-rest position in which the drilling head axis and that of the riveting head (16,40) are distinct, and a working position in which said drilling head axis and the riveting head axis (16, 40) coincide, with said means for setting the riveting head (38) in motion relative to the second carriage (34) include a parallelogram (102) whose shape can be changed.

2. Device (1) according to claim 1, wherein said means of setting the said riveting head in motion relative to the second carriage (34) includes:

two parallel arms (110) which form said parallelogram (102) whose shape can be changed, each articulated on one of its two ends on the second carriage (34) and articulated at the other of its ends on the riveting head (38);

a mechanical system (116) for changing the shape of the parallelogram (102) designed so as to cause, when setting the second carriage (34) in motion along a slide direction (118), a change in the shape of said parallelogram (102) from a first configuration which places said riveting head (38) in its at-rest position, to a second configuration which places said riveting head (38) in its working position, and vice versa.

3. Device (1) according to claim 2, wherein said mechanical system for changing shape (116) is a guide system which includes a pin (118) which is firmly attached to one of the parallel arms (110), with the said pin (118) sliding in a guide slot (120) when the said second carriage (34) is set in motion along the said slide direction (18).

4. Device according to claim 3, wherein said guide slot (120) successively exhibits a second portion (150) which allows the said parallelogram (102) to gradually change shape the until it has adopted its second configuration which places the said riveting head (38) in its working position, and a third portion (152) for maintaining the said parallelogram (102) in its second configuration, so that the said riveting head (38) is set in translation movement whilst retaining its working position in order to carry out the drilling operation.

5. Device (1) according to claim 3, wherein said guide slot (120) successively exhibits a first portion (148) which allows the said parallelogram (102) to be maintained in its initial configuration placing the said riveting head (38) in its at-rest position, a second portion (150) which allows the said parallelogram (102) to gradually change shape until it takes up its second configuration, placing the said riveting head (38) in its working position and a third portion (152) which allows the said parallelogram (102) to be maintained in its second configuration, so that the said riveting head is set in motion in translation whilst maintaining its working position in order to carry out the riveting operation.

6. Device (1) according to any of claims 3 to 5, further including a chassis (2) bearing the said guide slot (120) and on which are mounted both the said riveting system (6) and the drilling system (4) 'with the first and second carriages (10,34) each being arranged so as to be capable of sliding in a rectilinear manner relative to the chassis (2), along the said same slide direction (18), where the said drilling system (4) includes means (24) for setting the first carriage (10) in motion in the said slide direction (18), and where the said riveting system (6) also includes means (104) for setting the second carriage (34) in motion in the said slide direction (18).

7. Device (1) according to claim 6, wherein said means of setting the second carriage (34) in motion in the said slide direction (18) includes a rodless piston (104).

8. Device (1) according to claim 6, wherein said means (24) of setting the first carriage (10) in motion takes the form of a linear motor.

9. Device (1) according to claim 6, wherein said first carriage (10) is mounted on two guide rails (20) firmly attached to the said chassis (2), using multiple pads (22) in the form of callipers which fit against the said two guide rails (20) and which are firmly fixed to the first carriage (10).

10. Device (1) according to claim 9 wherein each of the said two guide rails (20) for the first carriage (10) have a core, where the two cores are arranged respectively in two inclined planes (P1, P2) which together form a V in a section taken orthogonally to the drilling head axis (16).

11. Device (1) according to claim 9 wherein each of the said guide rails (20) of the first carriage (10) has a transverse section in the form of an I.

12. Device (1) according to claim 6, wherein said first carriage (10) is fitted with a first reader head (30) designed to fit against an optical rule (32) placed on the said chassis (2).

13. Device (1) according to claim 6, wherein said second carriage (34) is mounted on a guide rail (46) firmly attached to the said chassis (2) and aligned along the slide direction (18), using at least one pad (48) in the form of a caliper which fit(s) against the said guide rails (46) and which is/are firmly fixed to the second carriage (34).

14. Device according to claim 6, further including a hold-down system (8) arranged in such a way so as to be capable of sliding in a rectilinear manner relative to the chassis (2), along the slide direction (18).

15. Device (1) according to claim 14, wherein said hold-down system (8) includes a third carriage (60) mounted on the said chassis (2), together with means (70) for setting this third carriage (60) in motion in the said slide direction (18).

16. Device (1) according to claim 15, wherein said means (70) of setting the third carriage (60) in motion takes the form of a linear motor.

17. Device (1) according to claim 16, wherein said means (24) of setting the first carriage (10) in motion takes the form of a linear motion, and wherein the linear motors (24, 70) of the first and third carriages (10, 60) have the same fixed secondary element (28) in common.

18. Device (1) according to claim 15 wherein said third carriage (60) is mounted on the said two guide rails (20) guiding the said first carriage (10), using multiple pads (68) in the form of callipers which fit against the two guide rails (20) and which are firmly fixed to the third carriage (60).

19. Device (1) according to claim 15, wherein said third carriage (60) is fitted with a second reader head (74) designed to fit against an optical rule (32) placed on the said chassis (2).

20. Device (1) according to claim 15, wherein said hold-down system (8) has a hold-down head (62) fitted on the said third carriage (60) and which defines a hold-down head axis (64) which coincides with the drilling head axis (16).

21. Device (1) according to claim 6, wherein said chassis (2) is fitted on a robotic arm of the device.

22. Device (1) according to claim 1, further including a control system (83) which includes means (82) for delivering advance speed settings for a drilling tool (17) for the device, along the drilling axis (16), together with rotation speed settings for this tool, with these settings depending on information on the local stiffness of panels at a hole to be drilled in order to receive a rivet.

23. Process for assembly of panels comprising:

riveting a panel using a device (1) according to claim 1.

* * * * *

UNITED STATES PATENT AND TRADEMARK OFFICE

CERTIFICATE OF CORRECTION

PATENT NO. : 8,533,932 B2
APPLICATION NO. : 12/294527
DATED : September 17, 2013
INVENTOR(S) : Maxime Hardouin-Finez It is certified that error appears in the above-identified patent and that said Letters Patent is hereby corrected as shown below:

In the specification, column 2, line 36, please replace "farmed" with -- formed --

In the specification, column 6, line 36, please replace "pert" with -- part --

In the specification, column 7, line 1, please replace "en" with -- an --

In the specification, column 7, line 35, please replace "27" with -- 17 --

In the specification, column 7, line 59, please replace "Precise" with an uppercase "P" to -- precise -- with all lower case letters In the specification, column 8, line 65, please replace "head relative" with -- head 38 relative --

In the specification, column 9, line 14, please replace "N" with -- H --

In the specification, column 11, line 48, please replace "mien" with -- then --

In the specification, column 14, line 22, please replace "pane:" with -- panel --

In the specification, column 14, line 43, please replace "panels during" with -- panels 80 during --

In the specification, column 15, line 31, please replace "tool or" with -- tool 36 or --

In the specification, column 16, line 24, please replace "10" with -- 18 --

In the specification, column 16, line 58, please replace "125" with -- 126 --

In the specification, column 17, line 29, please replace "36" with -- 38 --

In the specification, column 17, line 47, please replace "giver" with -- given --

Signed and Sealed this
Nineteenth Day of November, 2013

Teresa Stanek Rea

Teresa Stanek Rea
*Deputy Director of the United States Patent and Trademark Office*

In the specification, column 18, line 39, please replace “218” with -- 118 --

In the specification, column 18, line 61, please replace “246” with -- 146 --